US007188682B2

(12) United States Patent
Larsen et al.

(10) Patent No.: US 7,188,682 B2
(45) **Date of Patent: *Mar. 13, 2007**

(54) MULTI-STAGE DIFFUSER NOZZLE

(75) Inventors: James L. Larsen, Spring, TX (US); Godwin Apeh Gabriel, Abu Dhabi (AE); Michael A. Siracki, The Woodlands, TX (US); Dwayne P. Terracina, Spring, TX (US)

(73) Assignee: Smith International, Inc., Houston, TX (US)

( * ) Notice: Subject to any disclaimer, the term of this patent is extended or adjusted under 35 U.S.C. 154(b) by 167 days.

This patent is subject to a terminal disclaimer.

(21) Appl. No.: 10/610,017

(22) Filed: Jun. 30, 2003

(65) Prior Publication Data

US 2004/0069534 A1 Apr. 15, 2004

Related U.S. Application Data

(63) Continuation-in-part of application No. 09/736,613, filed on Dec. 14, 2000, now Pat. No. 6,585,063.

(51) Int. Cl.
*E21B 7/00* (2006.01)
*E21B 10/18* (2006.01)

(52) U.S. Cl. ..... 175/57; 175/340

(58) Field of Classification Search ..... 175/57, 175/65, 424, 340, 393, 429
See application file for complete search history.

(56) References Cited

U.S. PATENT DOCUMENTS 2,945,678 A * 7/1960 Boudreaux et al. ..... 175/317
3,070,182 A * 12/1962 Runte ..... 175/339
3,087,558 A * 4/1963 Dougherty, Jr. ..... 175/65
3,215,215 A * 11/1965 Kellner ..... 175/405.1
3,823,789 A * 7/1974 Garner ..... 175/340
4,071,097 A * 1/1978 Fulop et al. ..... 175/56
4,185,706 A * 1/1980 Baker et al. ..... 175/340
4,187,921 A * 2/1980 Garner ..... 175/340
4,189,014 A * 2/1980 Allen et al. ..... 175/339
4,369,849 A * 1/1983 Parrish ..... 175/340
4,378,853 A * 4/1983 Chia et al. ..... 175/340
4,619,335 A * 10/1986 McCullough ..... 175/339
4,673,045 A * 6/1987 McCullough ..... 175/339
4,687,067 A * 8/1987 Smith et al. ..... 175/340
4,690,229 A * 9/1987 Raney ..... 175/325.4
4,759,415 A * 7/1988 Pessier ..... 175/340
4,784,231 A * 11/1988 Higgins ..... 175/340
4,848,489 A * 7/1989 Deane ..... 175/429
4,856,601 A * 8/1989 Raney ..... 175/393

(Continued)

*Primary Examiner*—Hoang Dang
(74) *Attorney, Agent, or Firm*—Conley Rose, P.C.

(57) ABSTRACT

A multi-stage diffuser nozzle for use as a drill bit nozzle jet includes a flow restriction portion upstream of a fluidic distributor portion, and also preferably includes a transition region between these two. The flow restrictor communicates with the interior fluid plenum of a drill bit and is used to limit or restrict the total flow of drilling fluid by having a relatively small cross-sectional area for fluid flow. The fluidic distributor communicates with the flow restrictor and reduces the exit flow velocities of the drilling fluid as the drilling fluid is ejected from the nozzle by providing a relatively larger cross-sectional area for fluid flow. The fluidic distributor also directs the flow paths of the drilling fluid to locations such as cone surfaces that are prone to bit balling. The transition region is an area that dampens fluid pressure oscillations in the drilling fluid.

153 Claims, 18 Drawing Sheets

U.S. PATENT DOCUMENTS 5,293,946 A * 3/1994 Besson et al. ..... 175/424
5,355,967 A * 10/1994 Mueller et al. ..... 175/65
5,579,855 A * 12/1996 Dickey ..... 175/340
5,601,153 A * 2/1997 Ensminger et al. ..... 175/340
5,669,459 A * 9/1997 Larsen et al. ..... 175/340
5,775,443 A * 7/1998 Lott ..... 175/57
5,785,258 A * 7/1998 Akin et al. ..... 239/590
5,853,055 A * 12/1998 Siracki et al. ..... 175/340
5,921,476 A * 7/1999 Akin et al. ..... 239/590
6,065,683 A * 5/2000 Akin et al. ..... 239/5
6,142,248 A * 11/2000 Thigpen et al. ..... 175/340
6,192,999 B1 * 2/2001 Nguyen ..... 175/340
2002/0112889 A1 * 8/2002 Larsen ..... 175/57

* cited by examiner

MULTI-STAGE DIFFUSER NOZZLE

CROSS-REFERENCE TO RELATED APPLICATIONS

This is a Continuation-In-Part application of co-pending U.S. patent application Ser. No. 09/736,613, filed Dec. 14, 2000, which issued as U.S. Pat. No. 6,585,063.

STATEMENT REGARDING FEDERALLY SPONSORED RESEARCH OR DEVELOPMENT

Not Applicable.

BACKGROUND OF THE INVENTION

Nozzle jets have been used for several years in rotary cone rock bits both in or near the center of the rock bit and around the peripheral edge of the bit to encourage cone cleaning, to enhance removal of debris from a borehole bottom, and to efficiently cool the face of the rock bit.

Rotary cone rock bits are typically configured with multiple jet nozzle exits spaced at regular intervals along the periphery of the bit. High velocity fluid from these jet nozzles impacts the hole bottom and removes rock cuttings and debris. Center jets are also used in rotary cone rock bits for a variety of reasons. These include enhanced cone cleaning, protection against bit balling, and increased total flow of drilling fluid through the drill bit without creating washout problems.

Too much drilling fluid exiting the peripheral jets is believed to encourage undesirable re-circulation paths for drilling fluid at the bottom of the wellbore. In fact, all else being equal, it is thought desirable to have all or nearly all the drilling fluid exit the center jet. However, due to erosion concerns typically only 15 to 30 percent of the total hydraulic fluid (drilling fluid or drilling mud) flow passes through the center jet, with the remainder of the mud being jetted through the peripheral nozzles. In particular, excessive drilling fluid flow through the center jet causes flow erosion at the cutter surfaces such as the tips of the cutting teeth, resulting in premature failure of the rock bit. Even when fluid flow through the peripheral jets might be desirable, such as for cleaning the cutting teeth on the roller cones in sticky formations, excessive erosion of the cone shell and other components is a concern.

Many techniques have been used in an effort to optimize the bit hydraulics by modifying the nozzle configuration on the peripheral jets by moving the nozzle closer to the hole bottom, changing the nozzle jet vector, or both. U.S. Pat. Nos. 4,687,067; 4,784,231; 4,239,087; 3,070,182; 4,759,415; 5,029,656; and 5,495,903 teach modifications to the peripheral jets to improve the bit hydraulics, and each is hereby incorporated by reference for all purposes.

Three different types of nozzles are commonly used in center jet applications i.e. the diverging diffuser nozzle, the standard, non-diverging nozzle and the mini-extended nozzle. A less commonly utilized center jet nozzle has multiple discharge ports. Multiple exit nozzles are desirable since they offer the most flexibility to the designer to orient the flow patterns to clean the cutters or to improve borehole cleaning. However, multiple exit nozzles have two major design problems. First, the size for each of the exit ports is necessarily small because the total flow area (TFA) of a multiple exit nozzle is equal to the sum of the exit areas and to keep the total flow to within tolerable limits, the individual exit nozzles are necessarily small. As a result, the jet nozzle is prone to plugging. Second, the small nozzle size does nothing to reduce the exit flow velocity. Even though the flow is redirected, high fluid flow rates through each nozzle pointed toward metal components will likely lead to surface erosion and possible catastrophic failure.

A drill bit is needed that provides more efficient drilling fluid flow from the bottom of the borehole without increased erosion concerns around the drill bit. Ideally, this could be accomplished by a novel jet nozzle design or combination, so that the basic drill bit design would remain unchanged.

SUMMARY OF THE INVENTION

A disclosed embodiment of the invention is a drill bit with one or more attached multi-stage diffuser nozzles. The nozzles of this embodiment include a flow restrictor component distinct from a fluidic distributor component, allowing the selective matching of different sized or shaped flow restrictors and fluidic distributors. The flow restrictor has an internal passage to carry fluid from the liquid plenum of the drill bit, the internal passage including a throat of effective cross-sectional area $A_{0E}$. The fluid distributor, downstream from the flow restrictor, includes a fluid exit region with an effective cross-sectional area $A_{1E}$ greater than $A_{0E}$.

This embodiment of the invention may also include numerous variations. For example, the fluidic distributor may be designed to project drilling fluid toward the hole bottom at a variety of desired angles. To minimize undesired pressure fluctuations in the drilling fluid, a transition region of effective cross-sectional area $A_2$ may be added, either as a distinct component or not. Effective cross-sectional area $A_2$ would therefore be larger than either $A_{0E}$ or $A_{1E}$. The drill bit may also be designed so that the diffuser nozzle is either closer to the longitudinal axis of the bit or the periphery of the bit.

A second embodiment of the invention is a nozzle body which may be manufactured from only a single component. This nozzle body includes a first set of one or more passages at an upper end that, combined, are a first cross-sectional area. It also includes a second set of one or more passages at a lower end that, combined, are a second cross-sectional area, the second cross-sectional area being greater than the first cross-sectional area. In addition, the second set of passages directs at least a portion of the fluid along a vector that is not collinear with the central axis of the nozzle body. Similar to the first embodiment, this embodiment may advantageously include a transition region between the first and second sets of passages, the transition region having a cross-sectional area that is greater than either of the first or second cross-sectional areas. The first and second sets of passages may have a variety of configurations. For example, their cross-sectional areas may vary along their lengths, they may be circular or non-circular, they may direct drilling fluid from exit ports in the fluidic distributor at a variety of angles, they may be straight or curved, etc.

A third embodiment of the invention may be expressed as a method of controlling fluid flow through a drill bit. This method includes lowering the fluid pressure of drilling fluid flowing through a drill bit from an initial pressure (such as that present inside the fluid plenum) to a restrictor pressure, dampening the fluid pressure oscillations in the drilling fluid, and increasing the fluid pressure to an exit pressure (such as that present in the annulus of the wellbore). The exit pressure is necessarily higher than the restrictor pressure in this embodiment. The drilling fluid pressure may be lowered to the restrictor pressure by a first single passage, for example. The drilling fluid pressure may then be raised to the transition pressure by a second passage having a cross-sectional area greater than that of the first single passage. One implementation of this embodiment ensures that the difference between the initial pressure and the transition pressure is greater than the difference of the transition pressure and the exit pressure.

Another aspect of the invention is an assembly to fixedly orient a directional nozzle. The assembly includes a sleeve to receive the directional nozzle, the directional nozzle, and means to fixedly orient the nozzle in one or more desired directions. The preferred means to fixedly orient the nozzle is lobes on the diffuser portion of the nozzle and engagement slots on a lip of the sleeve.

Another aspect of the invention is a drill bit with a center multi-stage diffuser nozzle and diverging nozzles installed at non-central port locations. This drill bit design is believed to improve the drill bit's rate of penetration by improved cone cleaning and desirable flow paths.

The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
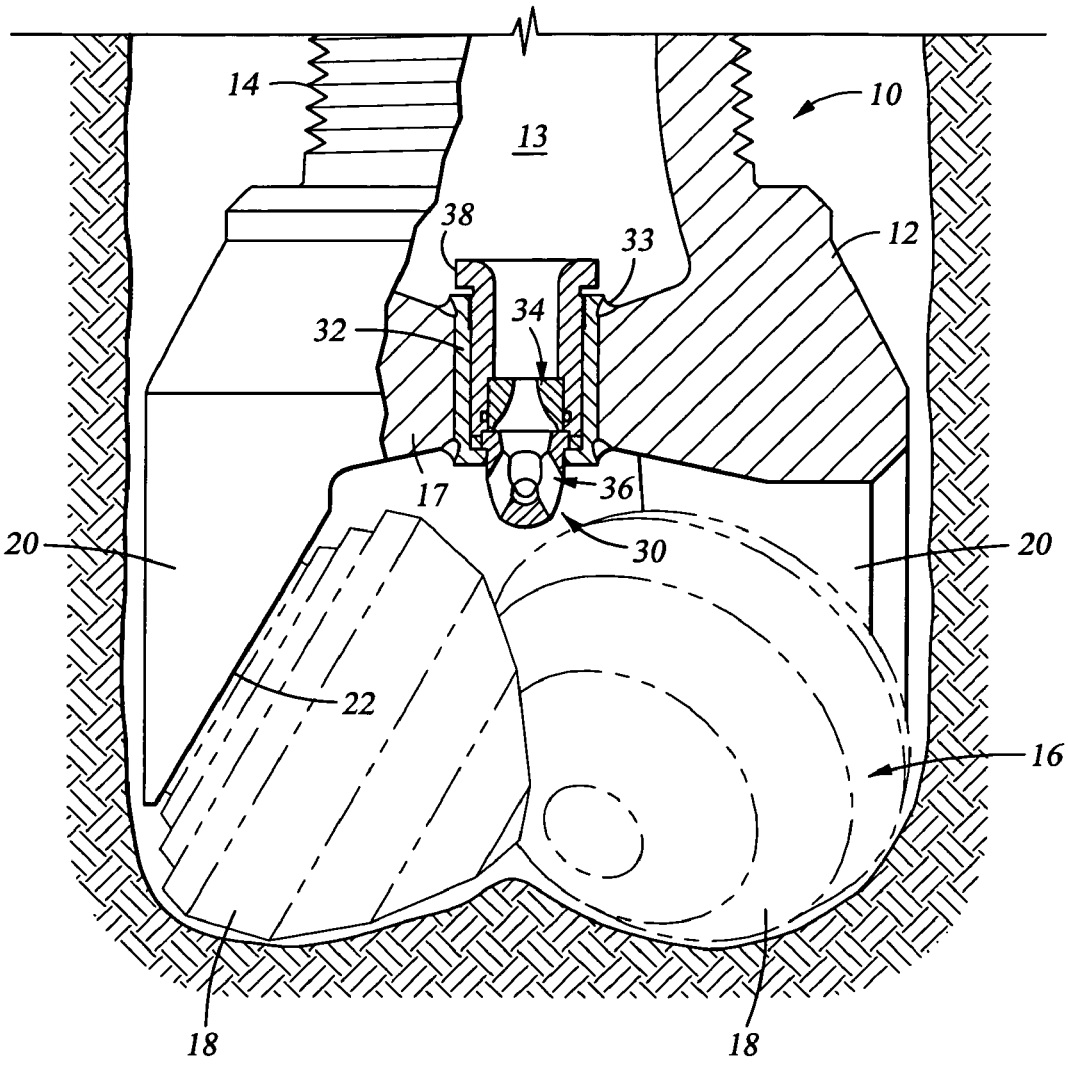
FIG. 1 is a front view of a drill bit including a multi-stage diffuser nozzle.

With reference now to FIG. 1, rotary cone rock bit generally designated as 10 consists of rock bit body 12, pin (upper) end 14 and cutting (lower) end generally designated as 16. A fluid chamber or plenum 13 is formed within bit body 12. The plenum 13 communicates with open pin end 14. Drill bit fluid or "mud" enters the bit body through the pin 14 via a drill pipe attached to the pin (not shown). A dome portion 17 defines a portion of the plenum 13 within body 12. Rock bit legs 20 extend from bit body 12 toward the cutting end 16 of the bit. A cutter cone 18 is rotatably fixed to leg 20 through a journal bearing extending into the cone from the leg backface 22 of the leg 20 (not shown).

Also shown is a multi-stage diffuser nozzle 30 according to a first embodiment of the invention. The multi-stage diffuser nozzle 30 of FIG. 1 generally includes two components, an upper flow restrictor 34 stacked on top of a lower fluidic distributor 36. Fluidic distributor 36 and flow restrictor 34 are inserted through the pin end 14 of the drill bit to a nozzle receptacle region 32. The multi-stage diffuser nozzle 30 is, for example, metallurgically bonded or welded 33 to the dome 17 of the bit 10.

Figure 2:
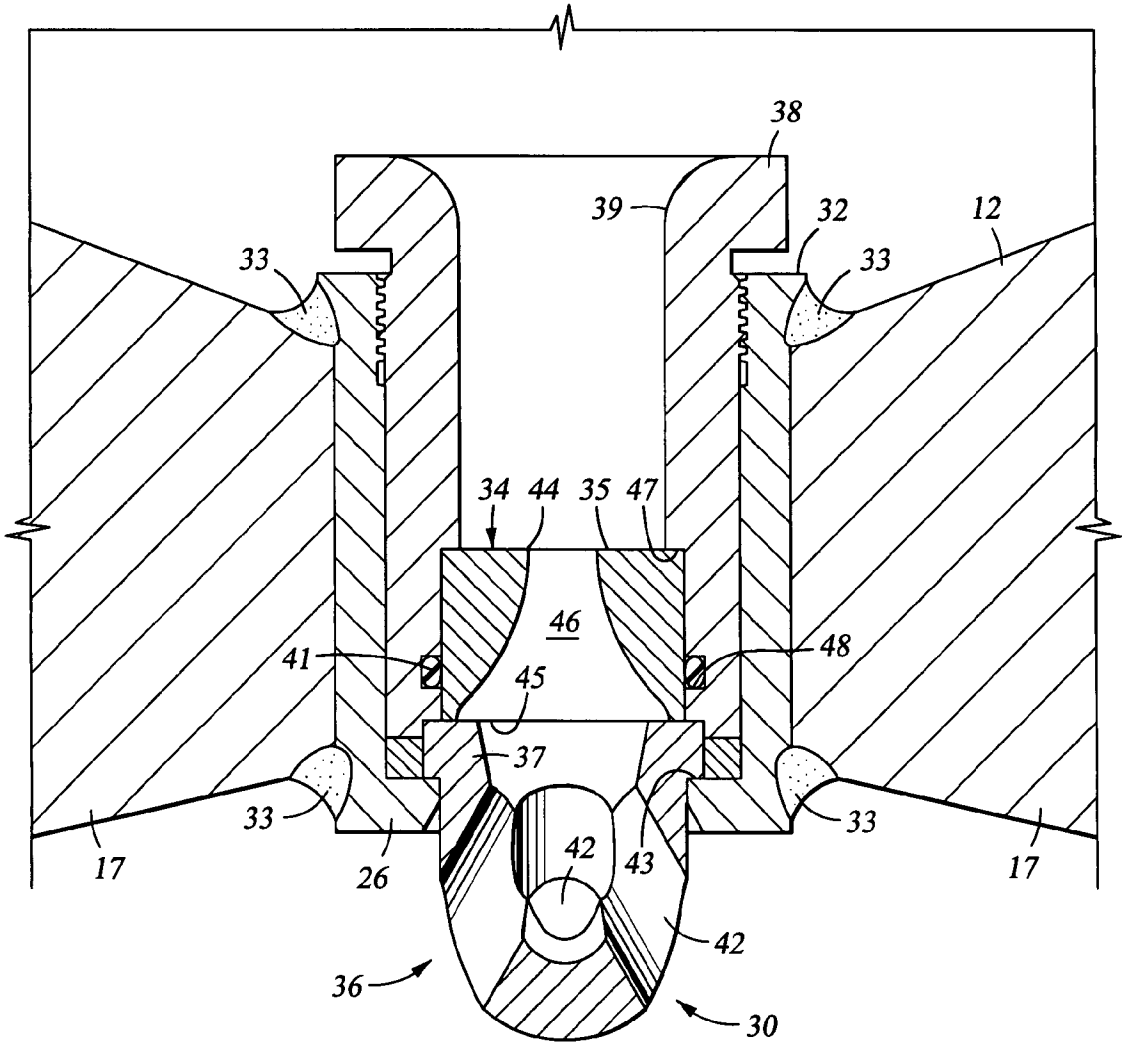
FIG. 2 is a close-up view of FIG. 1.

FIG. 2 is a close-up view of the multi-stage diffuser nozzle 30 in drill bit body 12. Nozzle retention flange 26 of receptacle 32 provides a stop for shoulder 43 of fluidic distributor nozzle body 37. An O-ring 41 is positioned adjacent the periphery of shoulder 43 and an inner wall formed by receptacle 32 prior to insertion of restrictor nozzle 34 upstream and adjacent to nozzle 36. A nozzle assembly retainer 38 is threaded into nozzle receptacle 32 after the restrictor nozzle is positioned adjacent to nozzle 36. A nozzle retention shoulder 47 and O-ring groove 48 is formed in the inner wall of the retainer 38. Shoulder 47 seats against body 35 of restrictor nozzle 34 and the O-ring 41 inhibits leakage of fluid by the restrictor nozzle. Rounded entrance 39 provides a relatively non-turbulent entry for drilling fluid from chamber 13 formed by bit body 12.

Figure 3:
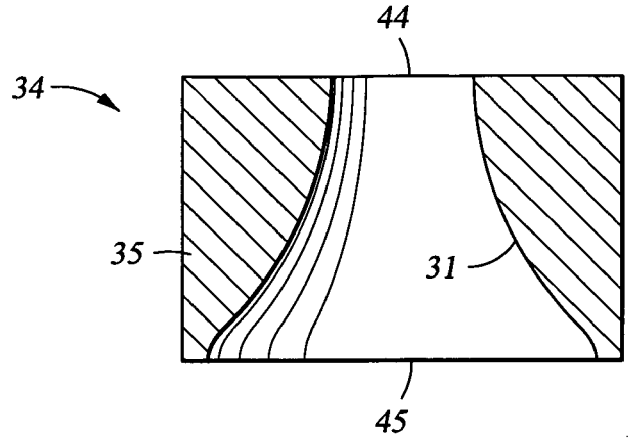
FIG. 3 is a cut-away view of a first flow restrictor.

FIG. 3 depicts the flow restrictor of FIGS. 1 and 2, generally a first nozzle designated as 34. Nozzle 34 is positioned upstream of and adjacent to a fluidic distributor generally designated as 36 (not shown in FIG. 3). The flow restrictor body 35 forms an inlet opening 44 that widely diverges toward outlet opening 45. For the pictured flow restrictor, inlet opening 44 is the location of minimum cross-sectional flow area, a location defined as the throat of the flow restrictor 34. Of course, a similar effect could be obtained by inverting the flow restrictor to make opening 45 an inlet and opening 44 an outlet. The flow restrictor body 35 is made of a wear resistant material such as carbide or ceramic or any other material that is sufficiently hard to minimize fluidic erosion. This harder material is necessary to protect the steel body 12 of the rock bit 10 from fluidic erosion caused by the high velocity fluid inside the flow restrictor body 35. It is also known that certain soft materials, such as rubber, are wear resistant yet suitable for downhole use and such materials may alternately be used. Erosion of the soft steel of the bit body 12 would lead to a washout of bit 10 which is unacceptable to the drillers that utilize the product.

Figure 4:
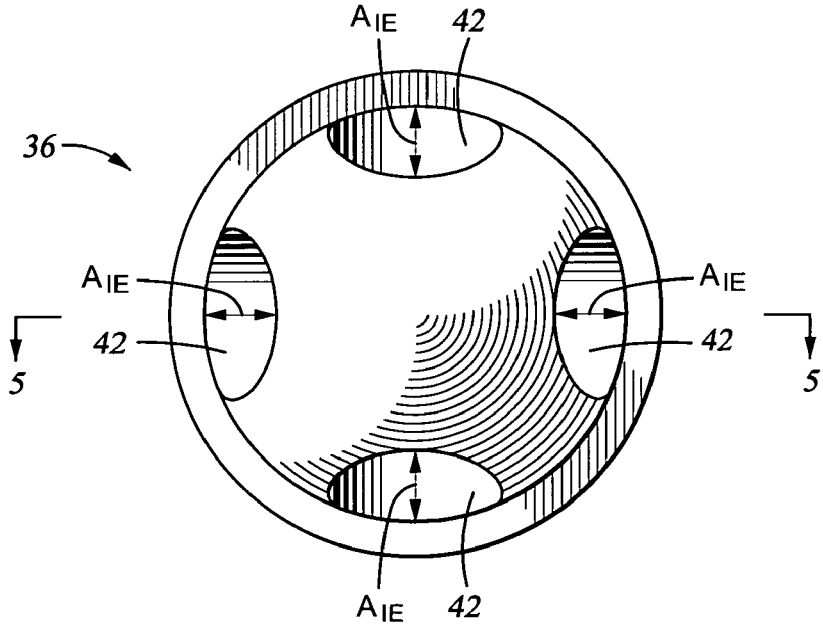
FIG. 4 is a bottom view of a first fluidic distributor.
Figure 5:
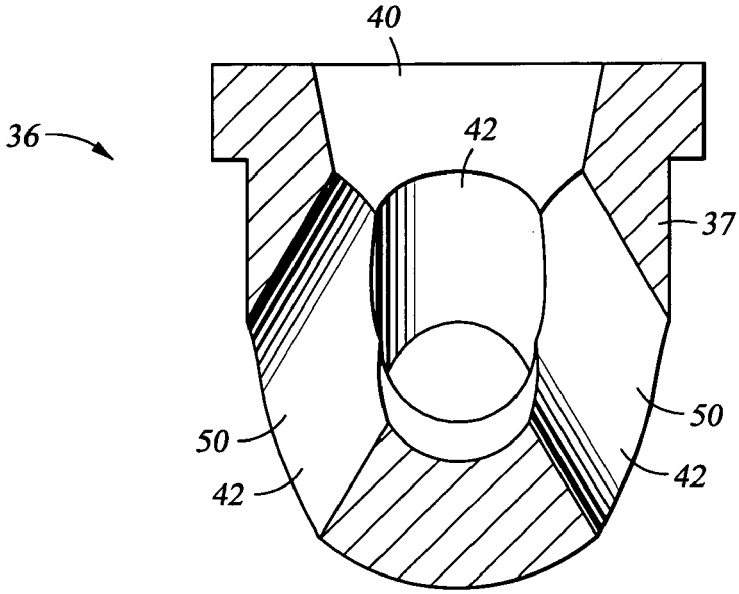
FIG. 5 is a cut-away side view of the first fluidic distributor taken along section line "5—5" in FIG. 4.

FIGS. 4 and 5 depict the fluidic distributor 36 of FIGS. 1 and 2. FIG. 4 is a bottom view of the fluidic distributor 36, showing four equally-sized exit ports 42 at non-central locations. Thus, multiple exit ports or nozzle outlets 42 formed in body 37 include at least one exit port disposed at an angle to the longitudinal axis of the fluidic distributor 36. FIG. 5 is taken along the cut line 5—5 of FIG. 4. As shown in FIG. 5, fluidic distributor 36 has nozzle body 37 with fluid inlet 40, in addition to exit ports 42. Exit passages 50 connect fluid inlet 40 with exit ports 42. The one or more exit passages 50 upstream of the respective exit ports 42 may have a cross sectional area less than the respective exit port. The cross-sectional area of the second nozzle is then the minimum cross-sectional area of each exit passage 50, added together, Consequently, the total summed area of the exit ports 42 is greater than the cross-sectional area at the throat of flow restrictor 34. The fluid distributor body 37 is made of a wear resistant material such as carbide or ceramic or any other material that is sufficiently hard to minimize fluidic erosion. This harder material is necessary to protect the steel body 12 of the rock bit 10 from fluidic erosion caused by the high velocity fluid inside the fluidic distributor body 37. It is also known that certain soft materials, such as rubber, are wear resistant yet suitable for downhole use and these materials may alternately be used. Erosion of the soft steel of the bit body 12 would lead to a washout of bit 10 which is unacceptable to the drillers that utilize the product.

Referring to FIGS. 1–5, the combination of the stacked nozzles 34 and 36 provides for independent control of the nozzle system restrictor mechanism and nozzle exit velocity mechanism. The flow restrictor 34 is used to restrict the flow of fluid through the multi-stage diffuser nozzle 30. Its most salient feature therefore is the small cross-sectional area of its throat channel, in this instance the inlet opening 44, and the accompanying pressure drop in the fluid passing through the inlet opening 44. The purpose of the second nozzle 36 is to reduce the drilling fluid exit flow velocities such that they will not erode the cone material (labeled 16 in FIG. 1), as well as to direct the flow paths of the drilling fluid to advantageous locations such as cone surfaces that are prone to bit balling.

The purpose of having a smaller area through the restrictor nozzle 34 than through the distributor nozzle 36 is to force most of the pressure drop across the nozzle system 30 to occur across the restrictor nozzle 34. In other words, a larger pressure drop occurs across the restrictor nozzle 34 than across the distributor nozzle 36. For the same total pressure drop across the system, a lower pressure drop occurs across distribution nozzle 36. The reduced pressure drop across the distribution nozzle 36 equates to lower nozzle exit velocities for the drilling fluid. Thus, many aspects of the invention can be characterized by a description of the relative pressure drops or velocities across a restrictor nozzle 34 and a distributor nozzle 36, or equivalent structure.

The flow rate through the multi-staged nozzle is adjusted by changing the orifice size of the flow restrictor 34. The average volumetric flow rate "Q" of the drilling fluid through an orifice, can be used to calculate the average velocity using the following equation:

$$V = \frac{Q}{A} \tag{1}$$

Where,

Q=Volumetric flow rate through the orifice;

V=Average velocity of the fluid flowing through the orifice; and

A=Effective cross-sectional area of the orifice.

Thus, as a given throat size of the flow restrictor is changed, the total flow through the multi-stage nozzle can be controlled.

The nozzle exit velocity of the drilling fluid is then controlled by the fluidic distributor 36. One aspect of the invention is that the total effective exit area from nozzle 36 is larger than the effective area of the throat in the restrictor nozzle 34. This lowers the exit flow velocity. Of course, the same principles could be used to increase the exit flow velocity by making the effective cross-sectional area of the flow distributor smaller than the flow restrictor, but bit designers are generally not seeking higher exit flow velocities in the locations where this invention would be proposed for use.

The average velocity of a fluid as it leaves each jet exit hole can then be determined by dividing the total volume flow rate (Q) through the multi-stage nozzle by the total nozzle exit area ($A_{1E}$) at the flow distributor. Because the total flow rate through the flow restrictor must be equal to the flow rate through the fluidic distributor, it can be determined from equation (1) that:

$$\frac{V_O}{V_I} = \frac{A_{IE}}{A_{OE}} \tag{2}$$

where, $V_0$=Velocity of the fluid through the throat in the flow restrictor;

$V_1$=Velocity of the fluid at the exit of the fluidic distributor $A_{0E}$=Effective area of the throat in the flow restrictor;

$A_{1E}$=Effective area of the exit ports of the fluidic distributor.

Because the total effective nozzle exit area, $A_{1E}$, is larger than the effective cross-sectional area of the throat, $A_{0E}$, the velocity of the fluid exiting the multi-stage diffuser nozzle, $V_1$, is lower than the velocity of the fluid as it flows through the throat, $V_0$. In fact, by use of equation (2) the exit velocity can be predictably controlled by increasing or decreasing the total effective nozzle exit area.

To understand the differences between various nozzle designs, the concept of an effective nozzle exit area should be explained. Effective nozzle size or effective cross-sectional area are terms used to describe the comparison of nozzle geometries based upon their pressure drop characteristics under fluid flow conditions. For example, when a given nozzle of certain design is exposed to a particular fluid flow, a specific pressure drop occurs across the nozzle. Another nozzle of the same general design but having a different throat diameter, under the same flow conditions, will produce a different pressure drop than the first nozzle. Thus, two nozzles having the same general nozzle design, under the same flow conditions, produce different pressure drops because of different throat areas. Similarly, two nozzle systems having significantly different internal geometries but the same throat diameter will likely produce different pressure drops, even under the same flow conditions. The energy losses associated with the different internal geometries will cause dissimilar pressure drop responses. For instance, a nozzle design with a smooth, streamlined entrance to the exit orifice will have a lower pressure drop than a nozzle with the same throat diameter but having a sharp 90 degree edge entrance. Consequently, depending on the design of the restrictor nozzle 34 and the distributor nozzle 36, the pressure drops across each may not accurately reflect their relative physical area sizes. In other words, if the design of the flow restrictor 34 is inefficient because of the selected geometry of the nozzle, its physical or measured throat diameter may actually be larger than the distributor nozzle 36. Nonetheless, the pressure drop across the restrictor nozzle 34 would still be greater than that across the distributor nozzle 36, making the restrictor nozzle a choking nozzle.

Figure 14:
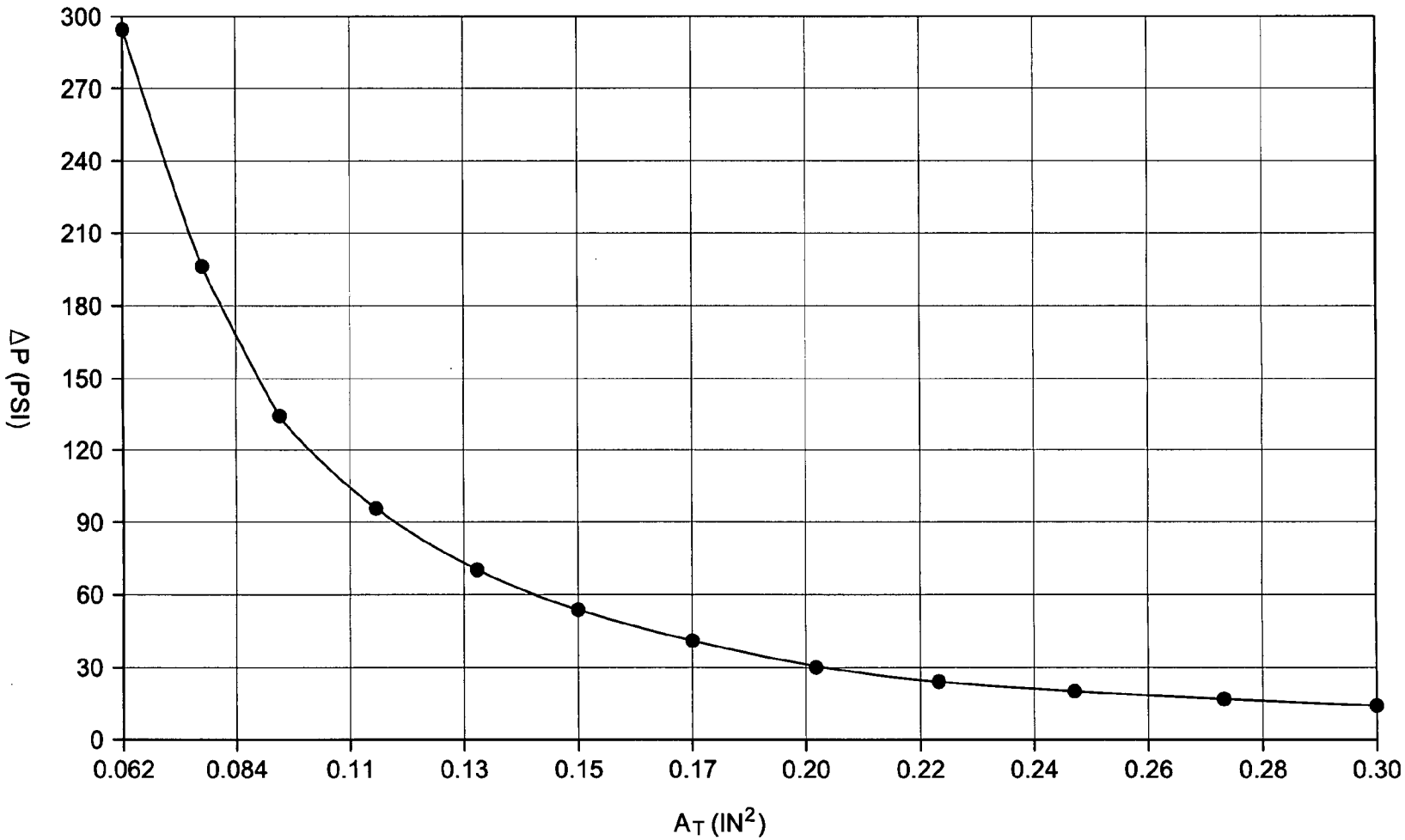
Fig. 14 (PRIOR ART)
FIG. 14 is a graph of the pressure drop characterization of a nozzle set used as a standard to determine the equivalent nozzle size for a restrictor and distributor nozzle components.

The effective cross-sectional area for a nozzle can be determined by measuring its pressure drop and comparing this pressure drop against a set of measurements made for a standard or baseline nozzle configuration. For example, assume that a nozzle system made with design "A" is considered the standard or baseline nozzle system. Pressure drop measurements could be made for design "A" at a variety of nozzle sizes and flow rates. FIG. 14 shows the pressure drop characteristics for a flow rate of 25 GPM (gallons per minute). A new nozzle system with design "B" having a physical throat diameter of 14/32" (and an area of 0.15 $in^2$) is tested with a flow rate of 25 GPM. If the internal geometries of baseline nozzle system design "A" and nozzle design "B" were generally the same, the expected pressure drop across nozzle design "B" would be approximately 50 PSI. However, due to its different internal geometry, the pressure drop of nozzle design "B" is 70 PSI, which is higher than the baseline standard nozzle having the same physical exit throat area. The effective nozzle area $A_E$ for nozzle design "B" is therefore determined by locating the baseline nozzle area for the measured pressure drop of 70 PSI which in FIG. 14 is approximately 0.13 $in^2$. Thus, while the nozzle from design "B" has a physical throat area of 0.15 $in^2$, and a physical diameter of 14/32 in., based on its pressure drop characteristics, it has an effective nozzle area of 0.13 $in^2$ and effective nozzle diameter of 13/32 in. (assuming circular cross-section) relative to the known standard baseline nozzle system. Through testing and subsequent evaluation, effective nozzle sizes can be determined for both the restrictor nozzle and the distribution nozzle (as well as the transition region explained below).

To further explain, the modified Bernoulli equation as derived in "Introduction to Fluid Mechanics" can be employed to characterize the differences between nozzle geometries. In its basic form the Bernoulli equation illustrates the relationship between velocity, pressure and elevation in a flow stream without consideration of losses incurred due to friction or those resulting from flow separation. In the modified Bernoulli equation, energy losses associated with pipe friction and geometric discontinuities in the flow field are added in to help better model the real situation. Thus the modified Bernoulli equation can be written as follows:

$$\frac{P_1}{\rho g}+\frac{V_1^2}{2g}+z_1=\frac{P_2}{\rho g}+\frac{V_2^2}{2g}+z_2+\sum\frac{fL}{D}\frac{V^2}{2g}+\sum K\frac{V^2}{2g} \tag{3}$$

Where $P_1$, $P_2$=Fluid pressures at the inlet ($P_1$) and the outlet ($P_2$);
$V_1$, $V_2$=Fluid velocities at the inlet ($P_1$) and the outlet ($P_2$);
$Z_1$, $Z_2$=Elevation at the inlet ($z_1$) and the outlet ($z_2$);
ρ=Density of fluid;
g=Acceleration due to gravity;
$f$=Friction factor;
D=Hydraulic diameter;
L=Length of pipe;
K=Minor loss coefficient.

Generally, in the case of nozzles, the distance L is inconsequential which results in the frictional losses being considered negligible. However, the minor loss contribution can substantially influence the flow stream, especially in regards to nozzles. Depending on their entrance geometries, exit geometries and internal flow path, the pressure drop across nozzles can be significantly different even in cases where the cross-sectional area at the throat and the flow rates are the same. These differences are addressed in the modified Bernoulli equation by the summation of the minor loss coefficients "K". Consequently, two nozzles having the same measured throat diameter but different equivalent or effective nozzle sizes will have different loss coefficients "K".

To illustrate the effect of the area on the overall flow rate, Equation (3) can be simplified with the following assumptions: First, ignore the frictional losses; second, assume the inlet area to the nozzle is much larger than the throat diameter of the nozzle; third, assume that all minor losses occur at the throat velocity; and fourth, ignore any changes in elevation. Using Equation (3), the flow rate through the nozzle can be calculated using the equation:

$$Q=\frac{A_T}{(K+1)^{\frac{1}{2}}}\sqrt{\frac{2\Delta P}{\rho}} \tag{4}$$

Where:

Q=Flow rate through the nozzle
ΔP=Pressure drop across the nozzle
$A_T$=Physical cross-sectional area
ρ=Density of fluid
K=Minor loss coefficient Thus, the flow rate through the restrictor nozzle 34 is directly related to the cross-sectional area of nozzle 34, at its minimum cross-section (i.e. at its throat), which will be referred to as the physically measured throat or $A_T$. It is also related to the square root of 1/(K+1). Thus, as the minor loss coefficient is increased through less efficient geometries, the nozzle becomes more restrictive and reduces the flow rate for a fixed ΔP even though the throat diameter remains constant. In effect, the inefficient geometry creates a nozzle that acts as a smaller, more restrictive, nozzle compared to a well designed streamlined nozzle set. The geometry element $A_T/(K+1)^{0.5}$ of equation 4 is called the restriction factor.

As stated above, the effective nozzle size is determined by comparing the pressure drop of a new nozzle system to some known baseline nozzle system. If the new nozzle is inefficient, the physical throat area $A_{OP}$ is increased until the pressure drop across the nozzle matches that of the standard nozzle system at the same flow rate. This can be done mathematically using the restriction factor. First, assume that we have two nozzle systems, a standard nozzle system and a new nozzle system. For the two systems to have the same or very similar flow rate vs. pressure drop characteristics, the flow restriction factors will be the same or very similar. The nozzle size required for the new nozzle system for an equivalent pressure drop is $$A_{T_N} = A_{T_S} \frac{(K_N + 1)^{0.5}}{(K_S + 1)^{0.5}} \tag{5}$$

Where $A_{TS}$=standard or baseline nozzle size (physical and effective are the same by definition for the baseline nozzle);

$A_{TN}$=Physical nozzle size of new or compared nozzle;

$K_N$=Minor loss coefficient of new nozzle; and $K_S$=minor loss coefficient of standard or baseline nozzle At this point, it is easy to see that when the minor loss coefficient $K_N$ of the new nozzle is increased, likely through less efficient geometry, the physical throat area of the new nozzle is increased to maintain an equivalent pressure drop across the nozzle. The effective cross sectional area $A_{TN}$ of the new nozzle system is thus defined as the area, $A_{TS}$, that characterizes the pressure response of the new nozzle system. Thus, for equation (5) to balance, the physical area $A_{TN}$ will be larger or smaller relative to the baseline nozzle to account for the differences in their respective minor loss coefficients $K_N$ and $K_S$. For example, assume that the baseline nozzle has an area $A_{TS}$ of 0.442 square inches and that $K_N$=0.5 and $K_S$=0.05. The physical area $A_{TN}$ of the new nozzle system is calculated to be 0.528 square inches. However, its effective cross sectional area would be 0.442 square inches based on its pressure drop response relative to the baseline system. Alternatively, through testing, the nozzle area $A_{TN}$ of the new nozzle could be incrementally increased or decreased and tested until it had the same pressure drop for the given flow rate as the baseline nozzle. While there are many methods that can be used to characterize the response of a nozzle system, the intent of such characterization for the purposes of this invention is only to establish the portion of the nozzle that restricts the flow and that which distributes the flow at an average lower velocity. The methodology of determining those characteristics is inconsequential.

Figure 7:
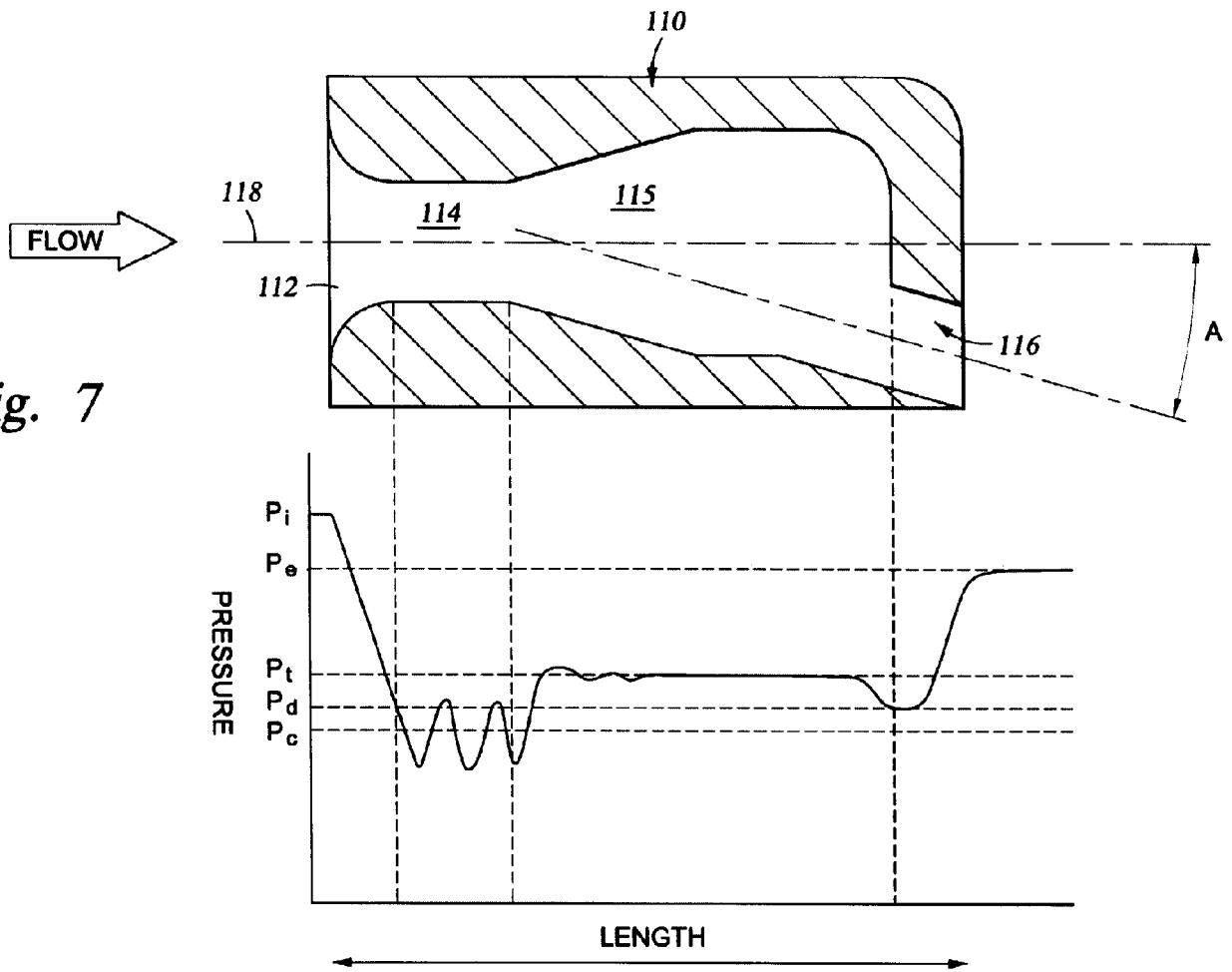
FIG. 7 is a second pressure/distance graph.

The effective cross-sectional area of the throat in the flow restrictor portion, $A_{OE}$, depends on the physical cross-sectional area of the throat, the geometry of the entrance to the throat region (sharp corners at the entrance to the throat tend to create an obstacle to fluid flow and therefore the effective cross-sectional area of the throat is smaller than if rounded corners were present at the entrance to the throat) and on certain downstream effects (a smooth downstream transition to a larger opening such as shown in FIG. 7 enlarges the effective cross-sectional area and draws more fluid through the throat than would an abrupt downstream opening). Two flow restrictors 34 having larger effective cross-sectional areas could be stacked together upstream of a fluidic distributor 36 to create the effect of a single flow restrictor having a throat of a smaller effective cross-sectional area. As another example, the flow restrictor may be a pulse jet. Other discontinuities or geometric alterations within the abilities of one of ordinary skill in the art may also be introduced to alter the efficiency, and therefore the effective cross-sectional area, of a structure.

By coupling the flow restrictor nozzle 34 with the fluidic distributor nozzle 36, thereby providing a nozzle design where the total exit area from nozzle 36 is larger than the throat 44 of the flow restrictor nozzle, fluid velocities exiting the two-component multi-stage diffuser nozzle can be reduced significantly. For example, most state of the art nozzles have exit velocities on the order of 200–400 ft/sec. In contrast, the principles of the invention can be used to reduce the nozzle exit velocities to impingement velocities on the cones to 100 ft/sec. or lower. Further, because this embodiment of the invention includes distinct flow restrictor and fluidic distributor components, the choking or flow restriction behavior of the multi-stage diffuser nozzle can easily be controlled independent of the nozzle system exit velocities. In particular, the flow rate through the jet can be controlled independent of the exit flow velocity by selectively matching a particular flow restrictor component with a particular fluidic distributor component just prior to insertion into the drill bit body. This also allows the decision to be made regarding the desired flow rate and exit velocity as late in the drilling job as possible.

In addition, this embodiment of the invention includes a plenum or chamber 46 formed between the restrictor nozzle 34 and the multiple exit nozzle 36. The plenum 46 is an optional transition region with a volume and design sufficient to slow the fluid flow, dampen fluid oscillations in the fluid flow, and generally steady the flow of fluid passing through the nozzle assembly 30 and out the multiple exits 42 formed by nozzle body 37. Preferably, the transition region has an actual cross-sectional area greater than the actual cross-sectional area of the throat. By significant reduction of the pressure surges and perturbations in the drilling fluid, the transition region helps to keep actual flow velocities at the exit ports close to the average flow velocity, and helps ensure that the drilling fluid is properly distributed among the exit ports of the multi-stage diffuser nozzle according to their size. Thus, although a transition region is not essential to the invention, it is a desirable feature of a multi-stage diffuser nozzle.

Figure 16A:
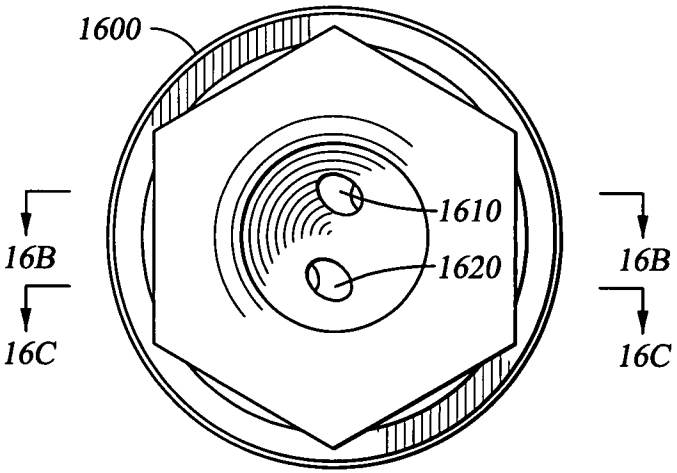
FIGS. 16A–C illustrate angled inlet passages for a multi-stage diffuser nozzle.
Figure 16C:
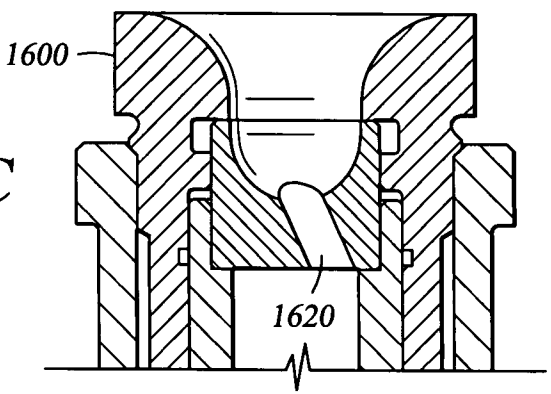
Figure 16B:
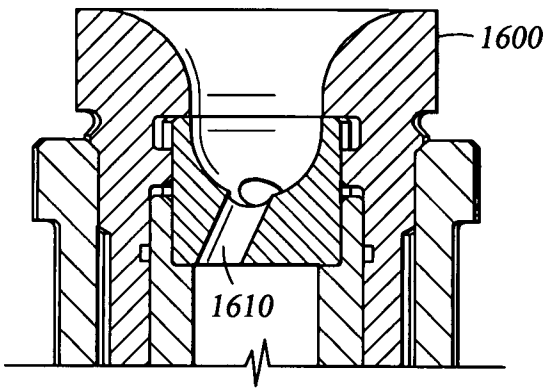

FIGS. 16A–16C illustrate another approach to distribute fluid evenly to the various fluid exit ports. In particular, FIG. 16A illustrates a top view of a multi-stage diffuser nozzle body 1600 having two angled passage entrances 1610 and 1620. FIG. 16B shows nozzle body 1600 forming a first internal passage 1610. FIG. 16C shows nozzle body 1600 forming a second internal passage 1620. By angling the inflow into the diffuser nozzle, rotational flow is imparted to the fluid traveling from the plenum and into the diffuser, which further minimizes fluid separation. This minimization of fluid separation results in a more even and reliable flow pattern from the exits of the multi-stage diffuser nozzle. Preferably, this approach is used in conjunction with a transition region to achieve maximum results.

Thus, one aspect of the invention is control of the exit fluid velocity from nozzles on the face of the drill bit. This allows an increased amount of drilling fluid to flow through the center of the drill bit, such as from 35 to 100 percent, and more preferably in specific designs any selected percentage from 50 to 75 to 90 to 100 percent.

Referring again to FIGS. 4 and 5, there is another aspect to the invention. The flow distributor 36 not only controls the exit velocity of the fluid, but also directs at least a portion of the drilling fluid at an angle away from vertical or the longitudinal axis. As best seen in FIG. 4, the first embodiment of the invention includes four equally-sized exit ports at the bottom of the jet. As best seen from FIG. 5, these exits correspond to an equal number of passages disposed at an angle to the longitudinal axis of the multi-stage diffuser nozzle. By altering the number and angle of the jet exits, drilling fluid may be directed to various locations under the drill bit. For example, fluids exiting from the multi-stage diffuser nozzle may now be directed at the cone surfaces without damage to the cones for optimal cleaning. It may also be desirable to angle the drilling fluid from different exit ports at various directions to assist the lifting of cuttings from the bottom of the borehole to the annulus, or to otherwise create and maintain flow zones at the bottom of the borehole. Angling of drilling fluid may also reduce re-circulation of the drilling fluid near the borehole bottom, which tends to interfere with efficient removal of borehole cuttings.

Figure 19:
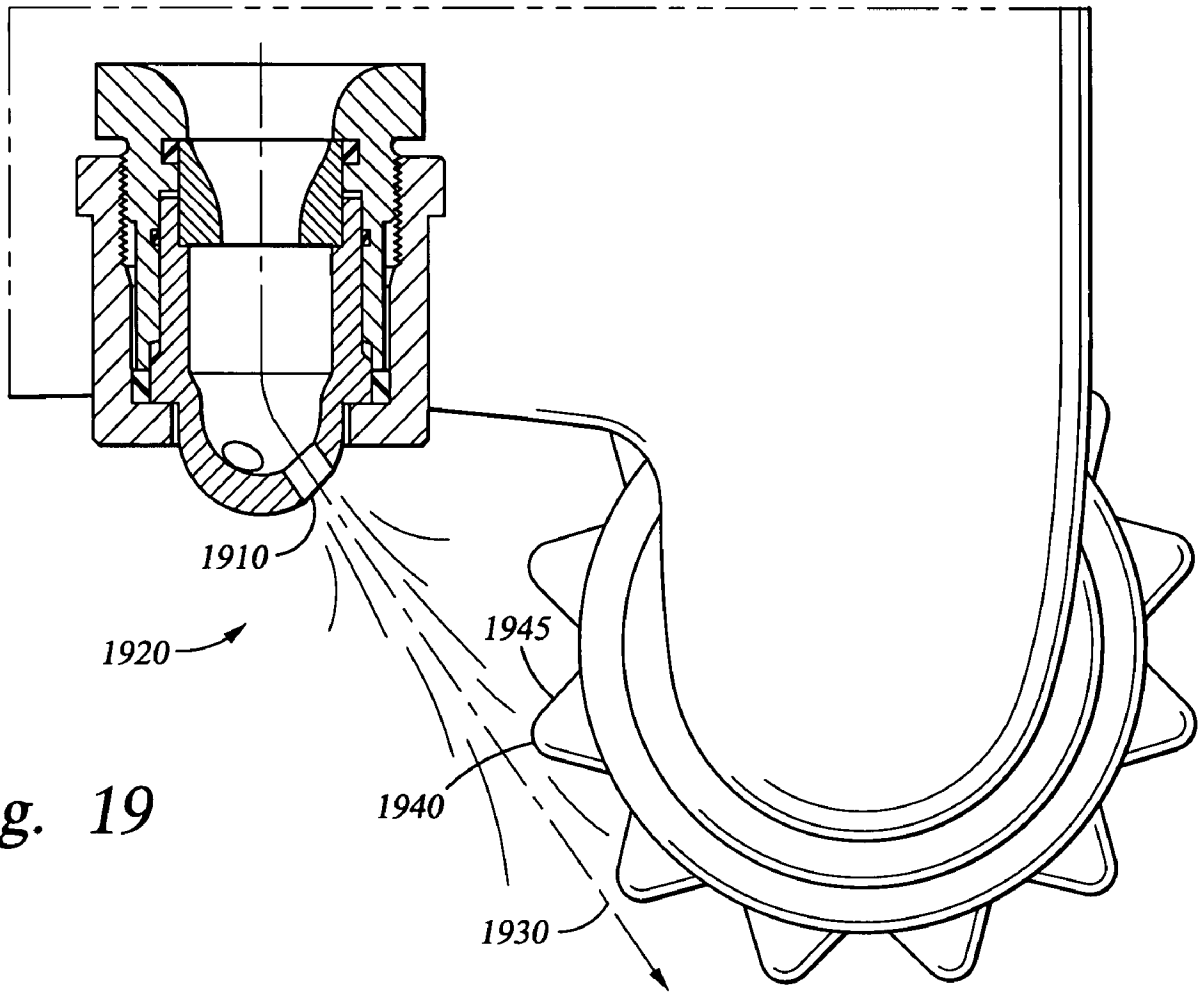
FIG. 19 shows a trajectory for a jet of fluid from a multi-stage diffuser assembly.

Referring to FIG. 19, a multi-stage diffuser includes at least a first exit port 1910. A jet of fluid 1920 exits the diffuser body. The multi-stage diffuser directs the jet of fluid to any desired location. To define the location of the fluid jet, it is necessary to determine the trajectory of the jet of fluid. In one sense, the trajectory can be expressed in terms of the velocity vectors for the fluid ejected from the diffuser body. Theoretically, this expression may best be used to describe the fluid dynamics and downhole effects of a jet of fluid and thus, this aspect of invention. However, observation and measurement of the real-world jet of fluid is difficult. A jet of drilling fluid ejected from a nozzle not only would need modeling or measurement of its various parts, but such an analysis is complicated because the fluid jet interacts with, e.g., other fluid in the borehole, the wellbore bottom and sides, cuttings, and the moving structure of the drill bit body.

To facilitate expression of this aspect of the invention, the trajectory of the fluid jet from the diffuser nozzle may be expressed as a line 1930 projected from the center of an exit port. This projected centerline 1930 from the diffuser nozzle exit port 1910 corresponds to the region in the fluid jet with the highest velocity, and thus the fluid jet may be defined as generally traveling along projected centerline 1930. This methodology works particularly well for nozzle orifice designs such as cylinders or other surfaces of revolution which direct the fluid in the direction of the projected centerline.

Cleaning of the cutting elements on the cone surface of the drill bit is often desirable to maintain an adequate rate of penetration for the drill bit. Projection of the centerline toward a cone to within 0.4" or less from a tip 1940 of the closest insert 1945 at its closest point (i.e. the minimum distance between the exit port centerline and the insert tip) is believed will result in improved cleaning of the cutting elements on the roller cones. It is believed that the projected centerline for larger drill bits may be slightly further away from the tip location, such as 0.5", and still receive the same benefits. Depending on velocity of the fluid, and the geometry of the fluid jet after being ejected from the nozzle, a distance of 0.25" may achieve better cone cleaning. Exactly how close the fluid is positioned to the cone cutting elements and the velocity and geometry of the fluid depends on numerous variables. The formation being drilled and its propensity for bit balling is one variable, the weight and composition of the drilling fluid is another, and other downhole conditions may be another. Of course, a significant advantage of the invention is its ability to control the exit velocity of the drilling fluid to whatever extent is desired, and thus the invention also includes projection of the centerline on the cutting tip itself, or even the cone surface, and control of the fluid velocity to prevent catastrophic failure of the rock bit. It is this flexibility that is so desirable to bit designers.

Figure 20:
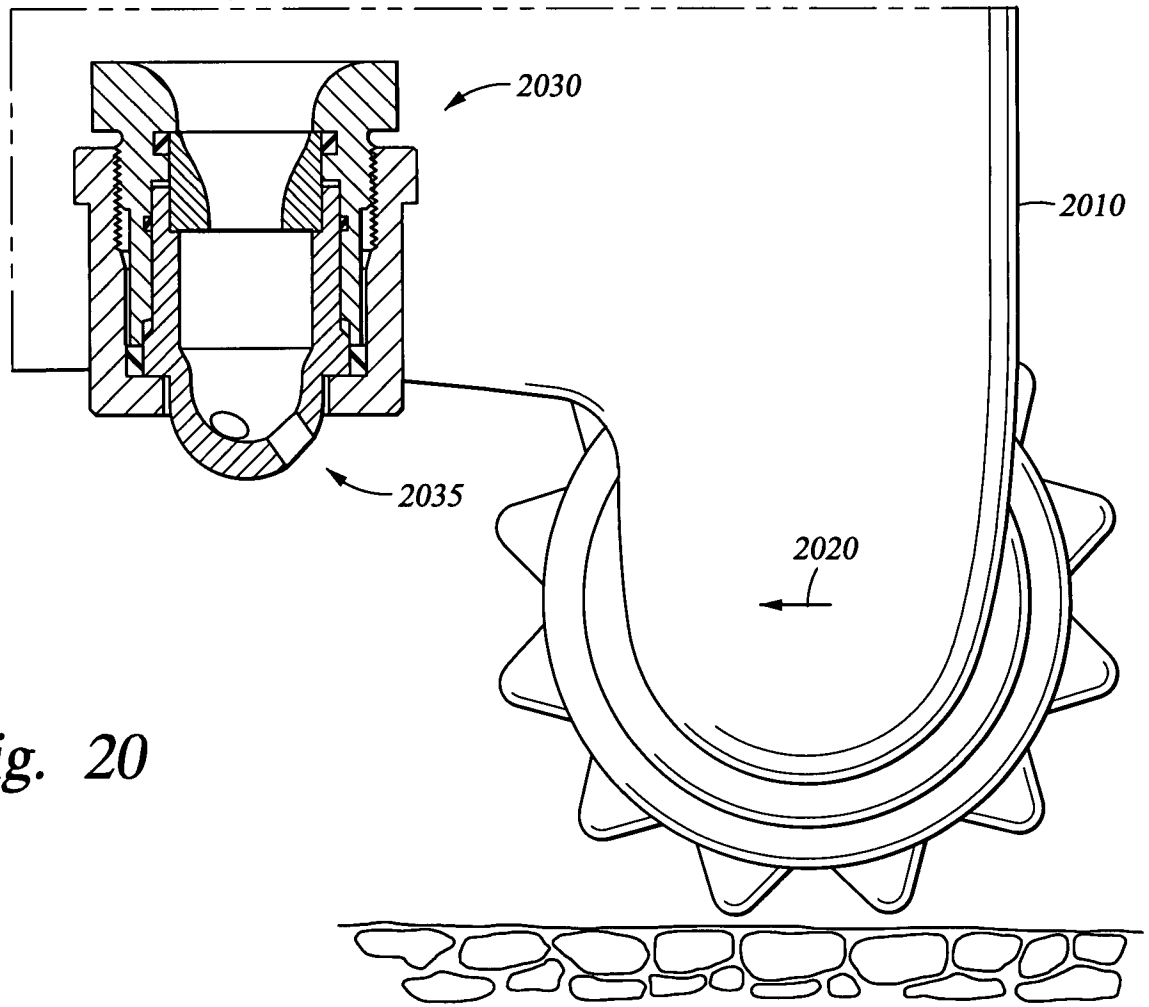
FIG. 20 shows the intersection of a journal axis and the exterior of a leg on a drill bit.

The location of the exit point of the multi-stage diffuser nozzles also is an aspect of the invention. As is well known, each roller cone of a drill bit rotates around a cylindrical journal. Each journal defines a journal axis. Referring to FIG. 20, an external view of a leg 2010 of a drill bit is shown. The intersection of a journal axis and the outside surface of the leg of the drill bit is marked at 2010. The exit point 2035 of the directional nozzle is above the intersection of the journal axis and the leg of the drill bit. Location of the directional nozzle, 2030, such as a multi-stage diffuser nozzle assembly, in this position above the intersection is believed to improve cone cleaning while creating preferable fluid flow path lines.

Figure 6:
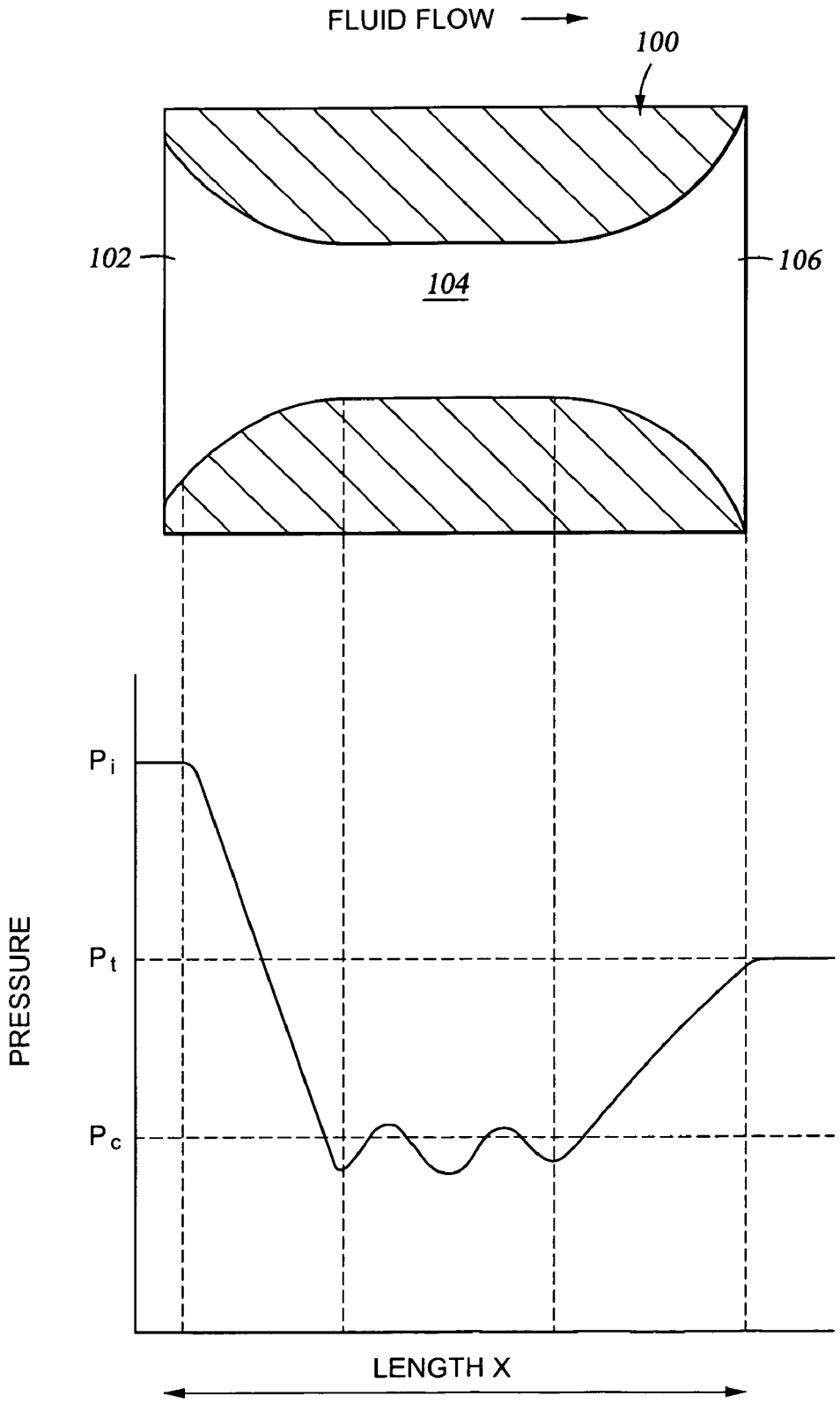
FIG. 6 is a first pressure/distance graph.

FIG. 6 shows an alternate flow restrictor nozzle design 100, and a corresponding pressure level-distance graph. Flow restrictor design 100 includes entrance 102, straight throat channel 104, and exit 106. As is understood by one of ordinary skill in the art, fluid velocity and fluid pressure are inversely related so that as the fluid accelerates and gains velocity as it flows its fluid pressure drops. Thus, prior to entering the entrance 102 of the flow restrictor 100, the pressure of the drilling fluid is at a relatively high pressure, $P_i$. The pressure of the fluid drops precipitously at the entrance 102 from a relatively high, $P_i$, to a much lower restrictor pressure, $P_c$, corresponding to the straight throat channel 104 of the flow restrictor nozzle. This sudden drop in fluid pressure causes turbulent fluctuations in the drilling fluid, as is shown by the oscillating fluid pressure corresponding to the length of the straight throat channel 104. At the flow restrictor exit, the fluid channel smoothly widens, resulting in a rise in the fluid pressure to an intermediate transition pressure, $P_T$. The total pressure drop across the restrictor 100 is defined as $\Delta P_R = P_i - P_T$.

FIG. 7 shows a multi-stage diffuser nozzle 110 with longitudinal axis 118, including entrance 112, throat channel 114, transition region 115, and fluidic distributor portion 116. In FIG. 7, only one exit port is explicitly shown, although it is to be understood that other exit ports at some angle to the longitudinal axis are also present. Also shown is a corresponding pressure level-distance graph. As with the flow restrictor of FIG. 6, before flowing into the entrance 112 of the flow restrictor 110, the drilling fluid has an initial pressure, $P_i$, at a relatively high level. The fluid pressure drops precipitously as the fluid enters the throat channel 114 and attains a relatively low restrictor pressure, $P_c$. The fluid pressure then rises to a transition pressure, $P_t$, as it leaves the throat channel and enters the transition region 115 having a cross-sectional area greater than the cross-sectional area of the throat channel. Transition pressure $P_t$ is a fluid pressure lower than the initial pressure, $P_i$, but higher than the restrictor pressure, $P_c$. It is while the drilling fluid is in the transition region 115 that the perturbations and fluctuations in the fluid reduce and die down. Upon entering a diffuser exit channel, the fluid pressure drops to a level $P_d$ lower than the transition pressure, but above that of the restrictor pressure, $P_c$. After leaving the multi-stage diff-user nozzle the fluid pressure rises once again, up to an exit pressure, $P_e$. The total multi-stage pressure drop is thus defined as $\Delta P_m = P_i - P_e$ where $P_i > P_e$.

There is therefore a distinct fluid pressure relationship amongst the flow restrictor, the transition region, and the flow distributor portions of a preferred multi-stage diffuser nozzle. In a flow restrictor portion, the drilling fluid undergoes a significant pressure drop, which is followed by a pressure recovery in the transition portion, and which is finally followed by a pressure drop corresponding to the fluidic distributor portion of the nozzle. Given a transition region of sufficient size, oscillations in fluid pressure are reduced significantly or die out prior to the fluid flowing into the multiple exit ports of the fluidic distributor portion. Obviously, this pressure relationship changes somewhat in a multi-stage diffuser nozzle that does not have a transition region or where the transition region is very, small.

Figure 8A:
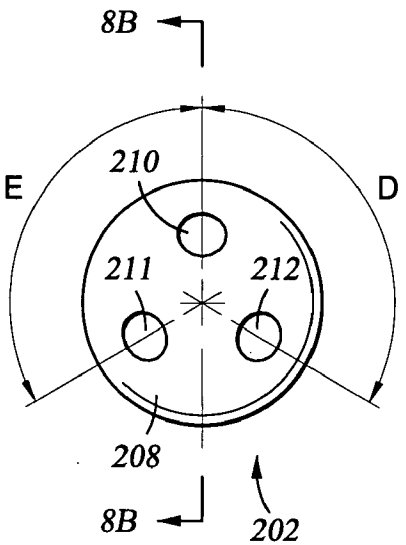
FIGS. 8A and 8B are bottom and cut-away side views of an alternate multi-stage diffuser nozzle.
Figure 8B:
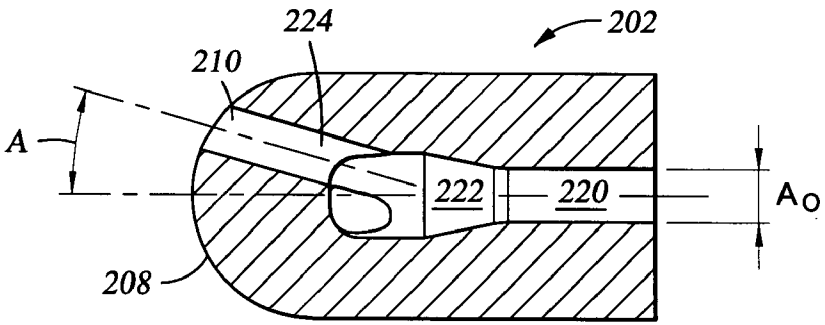

Numerous variations to the basic designs are possible. Referring now to FIGS. 8A and 8B, an embodiment of the invention is shown that has a unitary (i.e. one-piece) body. FIG. 8A, a bottom view of a multi-stage diffuser nozzle 202, includes three circular exit ports 210–212, each at a non-central location in a nozzle bottom 208. Exit ports 211–212 are disposed at angles E and D, respectively, as measured with respect to a line running through the centers of the nozzle (as shown in FIG. 8A) and exit port 210. FIG. 8B is taken along line I—I of FIG. 8A, which runs through exit port 210. A multi-stage diffuser nozzle 202 includes a flow restrictor region 220, a transition region 222, and a flow distributor region 224. Flow distributor region 224 is disposed at angle A, about 15 degrees away from centerline. In this embodiment, the flow distributor regions associated with exit ports 211 and 212 are angled about 15 degrees away from centerline as well. Restrictor region 220 has a throat diameter of $A_0$. The transition zone 222 has a maximum diameter greater than the throat diameter $A_0$. Each exit port 210–212 (one is shown in FIG. 8B) has some (although not necessarily the same) diameter of $A_i$. With n exit ports, $A_0$ and $A_i$ of the invention are related as:

$$A_0 < \sum_{i=1}^{n} A_i \tag{7}$$

In other words, the effective cross-sectional area of the flow restrictor is less than the effective cross-sectional area of the fluidic distributor.

Figure 9B:
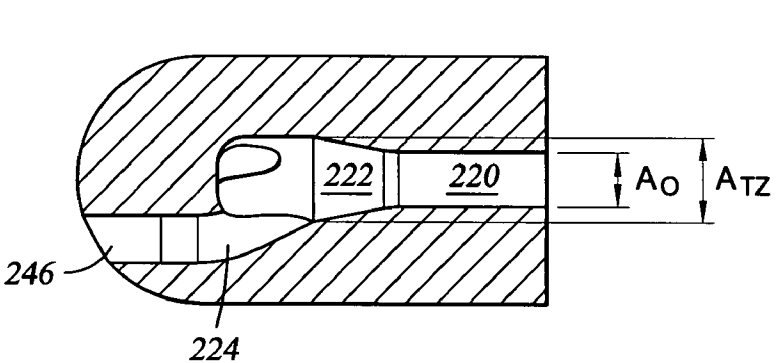
FIGS. 9A–9D are views of another multi-stage diffuser nozzle.
Figure 9D:
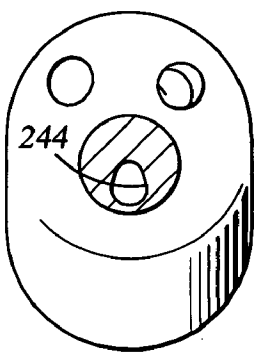
Figure 9A:
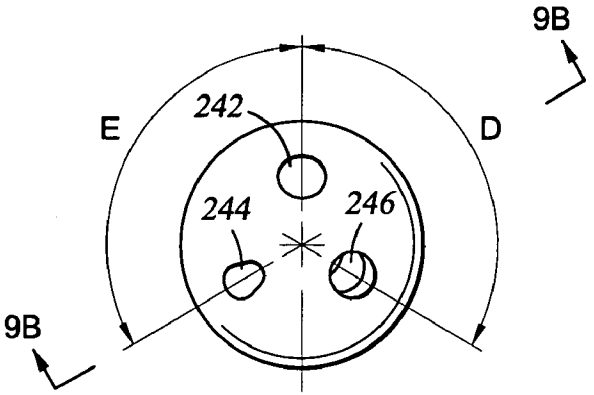
Figure 9C:
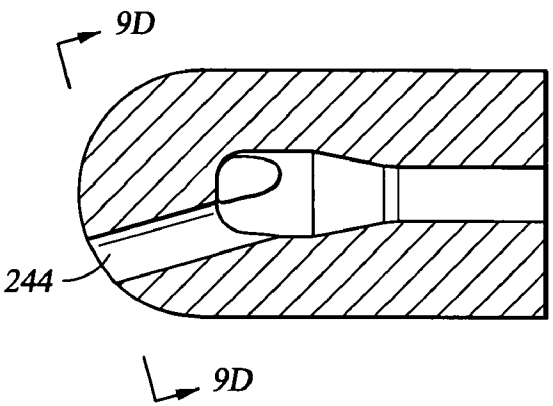

FIG. 9A is a bottom view of a different multi-stage diffuser nozzle. Three exit ports 242, 244, 246 are shown, each at a non-central location. FIG. 9B is taken along line I—I of FIG. 9A, and shows an alternate exit port design, including restrictor region throat diameter $A_0$, transition zone diameter $A_{TZ}$, and flow distributor region 224. In this embodiment, the transition region 222 connects to a flow distributor region 224 which comprises, in part curved exit channel, which then itself transitions into a straight channel parallel to the nozzle centerline. FIG. 9C is taken along line I—I of FIG. 9A, shows a flow distributor region having an exit channel and an exit port with non-circular shapes. The non-circular shape of the exit port may be seen more easily from FIG. 9D. Of course, the exit port may be of any suitable shape, including a slit or a square.

Figure 10A:
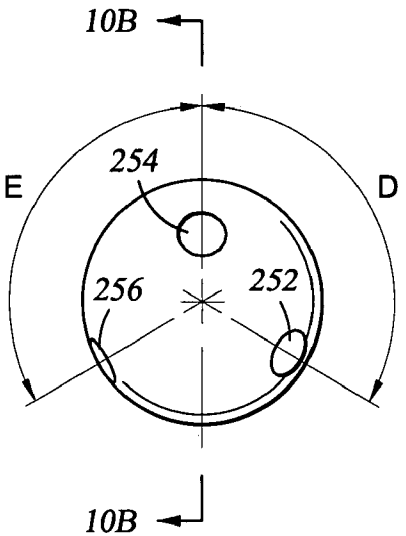
FIGS. 10A and 10B are bottom and cut-away side views of yet another alternate multi-stage diffuser nozzle.
Figure 10B:
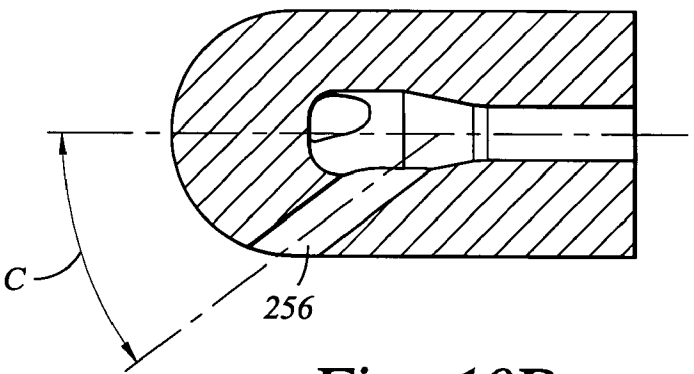

FIG. 10A is a bottom view of yet another multi-stage diffuser nozzle. As before, three exit ports 252, 254, and 256, are shown (although any desired number of exit ports may be employed). In this embodiment exit port 256 exits from the side of the multi-stage diffuser nozzle. This side exit port may be most easily seen in FIG. 10B.

Figure 11A:
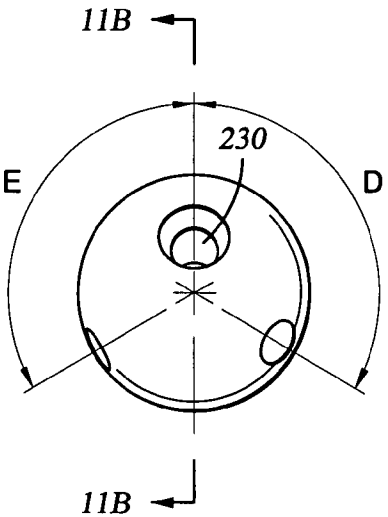
FIGS. 11A and 11B are bottom and cut-away side views of a variation to the multi-stage diffuser nozzle design.
Figure 11B:
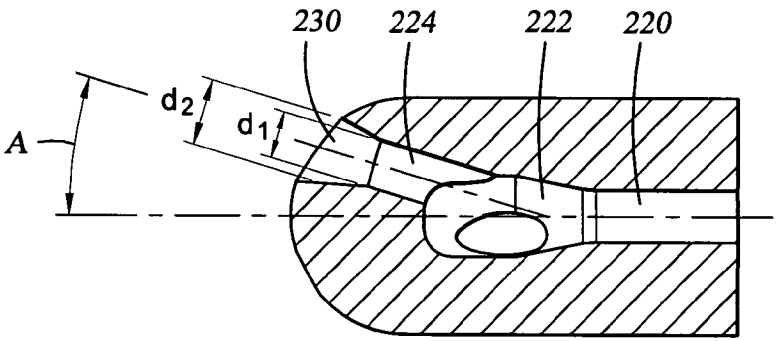

FIG. 11A is a bottom view of a multi-stage diffuser nozzle that has a diffused exit port 230. Referring to FIG. 11B, taken along line I—I of FIG. 11A, the multi-stage diffuser nozzle includes throat portion 220, transition portion 222, and fluidic distributor portion 224. Fluidic distributor portion includes a single exit channel of minimum diameter $d_1$ and an exit diameter $d_2$, with $d_2>d_1$. This diffusive channel will improve the efficiency of the fluidic distributor and make the effective cross sectional area larger than if no diffusive section were added. The diffusive section will also help to further reduce exit velocity for the drilling fluid. The second and third exit ports have the standard, circular geometry in the pictured embodiment.

Figure 12A:
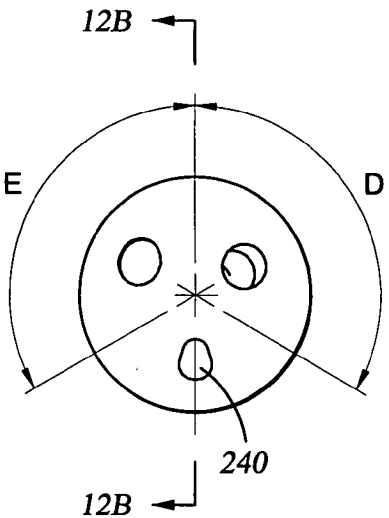
FIGS. 12A and 12B are bottom and cut-away side views of an alternate multi-stage diffuser nozzle.
Figure 12B:
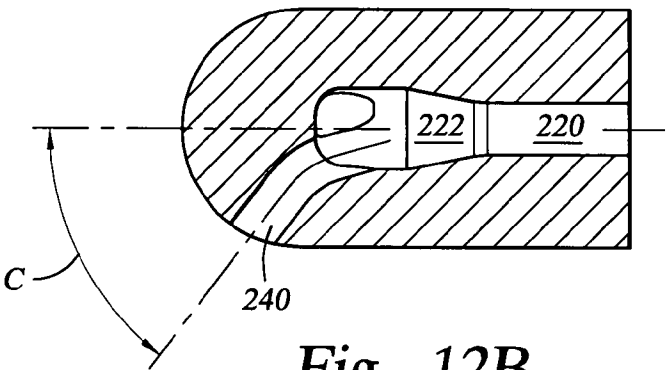

FIG. 12A is a bottom view of a multi-stage diffuser nozzle that has a curved exit channel 240. Referring to FIG. 12B, the nozzle exit channel 240 connects to transition region 222 and curves outward to an angle "C" from the nozzle centerline.

Figure 13A:
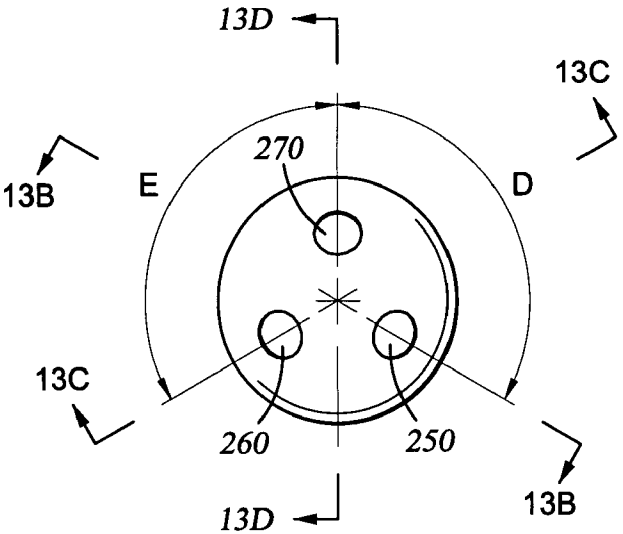
FIGS. 13A–13D are bottom and cut-away side views of an alternate multi-stage diffuser nozzle.
Figure 13B:
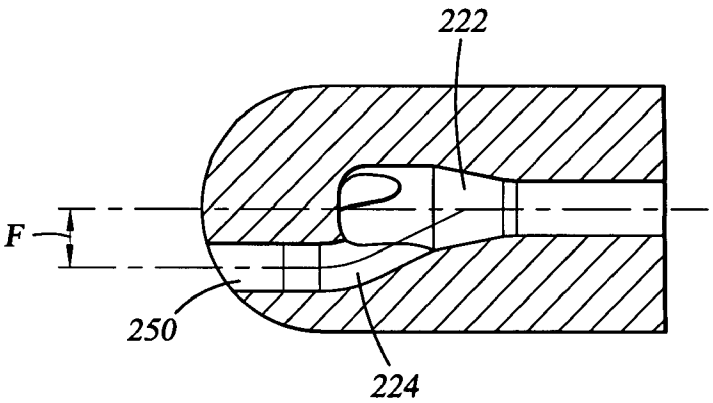
Figure 13C:
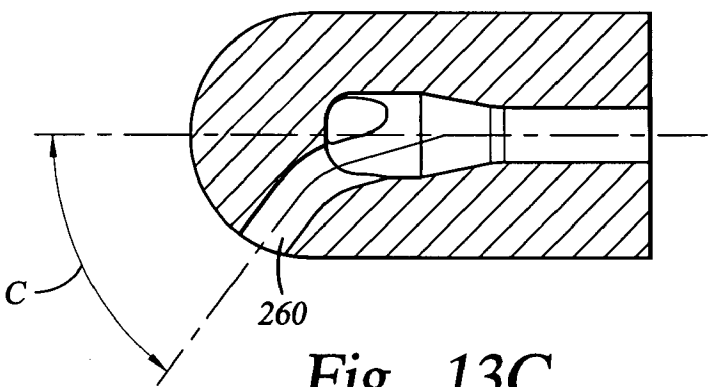
Figure 13D:
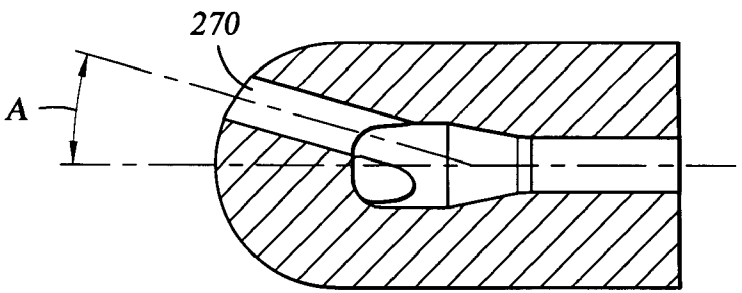

FIG. 13A is a bottom view of a multi-stage diffuser nozzle that has a combination of the above-described exit channels as part of its flow distributor region 224. FIG. 13B is taken along line I—I of FIG. 13A, and shows an exit channel 250 that branches off from the transition region 222 and then runs parallel to the nozzle centerline. FIG. 13C is taken along line II—II of FIG. 13A, and includes a curved exit channel 260. FIG. 13D is taken along line III—III of FIG. 13A, and shows a straight exit channel 270. The use of different channel and exit port configurations allows for the design of optimal flow regimes that can emphasize different functions such as creation of desirable flow fields to prevent the build up of debris or by utilizing the fluid energy to clean the hole bottom or inserts on the cones.

Figure 15:
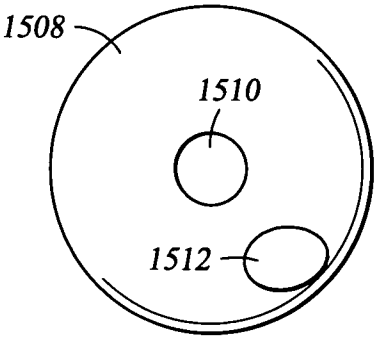
FIG. 15 is a bottom view of a nozzle showing central and non-central exit ports.

Of course, the multi-stage diffuser nozzle can be manufactured to eject drilling fluid at any angle from each exit port, and different angles may be used for different exit ports. FIG. 15, for example, shows a flow restrictor body 1508 having a first exit port 1510 at the centerline of the diffuser nozzle, and a second exit port 1512 disposed at a distance from the central nozzle. Any number of exit ports may be drilled or otherwise formed as part of the fluidic diffuser, and extension nozzles may be added to one or more of the exit ports for any desired purpose, such as to add length or additional ports. The design may even be altered so the purpose of the flow restrictor or fluidic distributor is accomplished by the combined action of multiple passages or channels.

Figure 17:
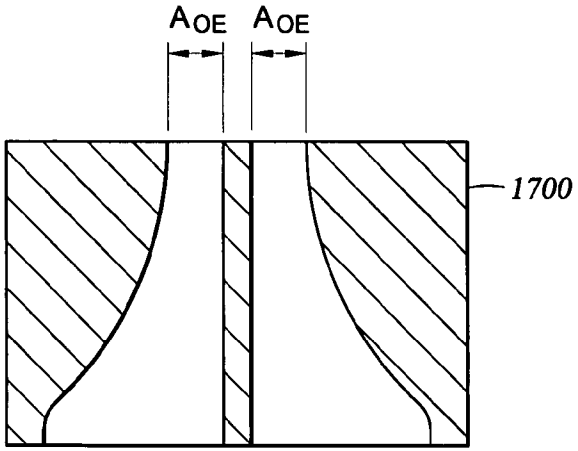
FIG. 17 is a cut away view of a flow restrictor having two flow passages.

FIG. 17 is a cut away view of a flow restrictor 1700 having two flow passages.

Figure 18B:
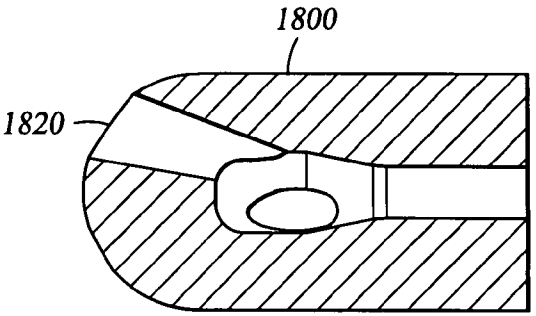
FIGS. 18A–18C show a multi-stage diffuser nozzle having differently sized exit passages.
Figure 18C:
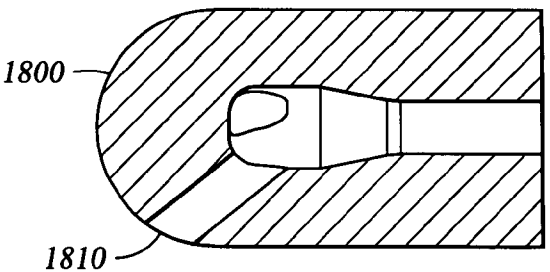
Figure 18A:
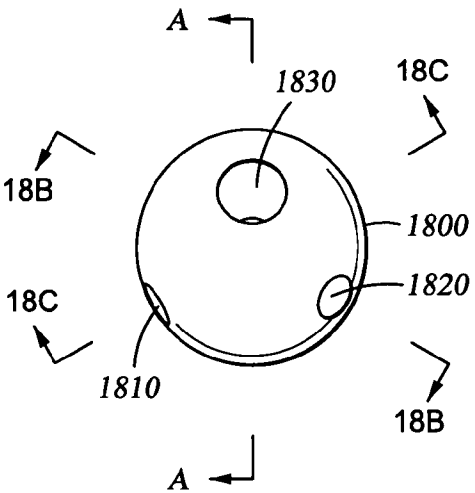

FIGS. 18A–18C are Figures of a multi-stage diffuser nozzle 1800 having differently sized exit passages 1810, 1820, 1830.

The multi-stage diffuser nozzle provides the drill bit designer great flexibility. Because the exit velocities of the drilling fluid from the nozzle jets can be reduced significantly, it allows a substantially higher fraction of drilling fluid to be ejected from a center jet if that is what is desired. The fraction of drilling fluid ejected from the peripheral jets may therefore also be controlled. Regardless of whether the principles of the invention are utilized for a center jet or a peripheral jet, the drilling fluid flowing through the multi-stage diffuser nozzle may be split into two or more portions, directed at an angle away from the centerline of the multi-stage nozzle, or otherwise manipulated. Different designs of multi-stage assemblies may be utilized at different locations on the drill bit. For embodiments of the invention that include distinct flow restriction and fluidic distributor components, further flexibility is provided in the field, where a last minute determination can be made economically for the most desirable flow rate and exit velocity.

Figure 21:
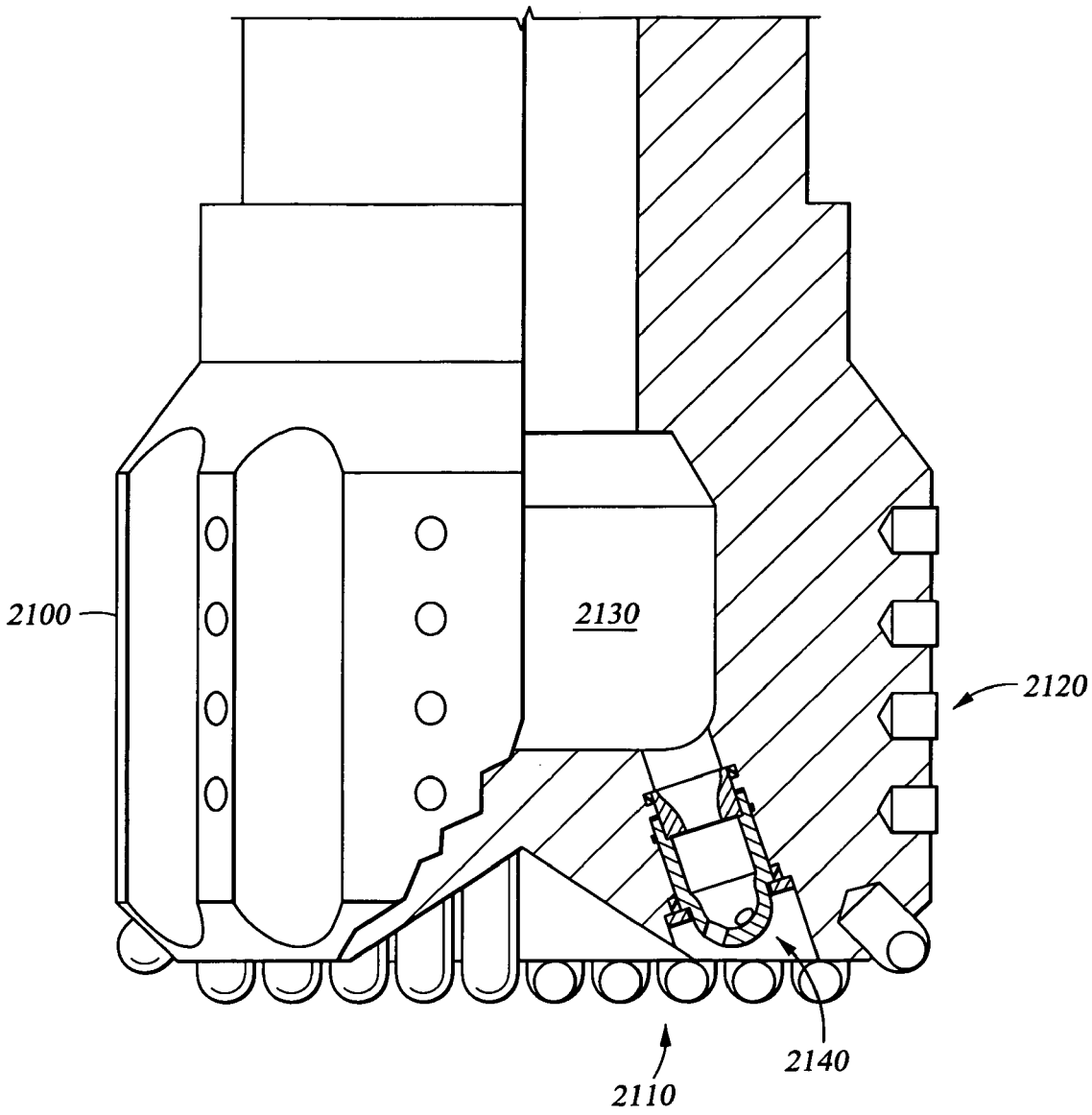
FIG. 21 shows a multi-port nozzle assembly on a PDC drill bit.

While the embodiments are shown on roller cone bits, the invention could likewise be used on fixed cutter (PDC) type bits. The invention could likewise be used on fixed cutter (PDC) type bits. These are also known as drag bits. Referring to FIG. 21, a PDC drill bit body 2100 includes PDC cutting elements 2110 at its bottom. Inserts 2120 are placed along the shirttail of drill bit body. A fluid plenum 2130 connects to a multi-stage assembly 2140.

In typical drilling applications, nozzles are generally used that have no nozzle orientation required. While the multi-staged diffuser can be installed into the bit without regard to its orientation relative to the cones, it is preferable that it be installed at an indexed (pre-calculated) position within the body of the bit. Indexing the multi-staged diffuser will ensure that the distribution ports are vectored to the desired locations and will generate the desired effect. This could be done by simply orienting the diffuser to the predetermined position and locking it with the retaining nut through frictional forces. Alternatively, it could be done with indexing pins or grooves that would only allow a single predetermined installation orientation or a set of predetermined installation orientations.

An aspect of the invention is a method and structure to fix the orientation of the nozzle relative to the bit cutting structure. This aspect of the invention is particularly suited for use with a multi-stage diffuser assembly although it may also be used with no ill effect with other any other appropriate type of nozzles such any other sort of diffuser nozzle, mini-extended nozzles, or standard nozzles.

FIGS. 22–27 show an orientation system for orienting a directional nozzle, such as the disclosed multi-stage nozzle assembly. In one embodiment, this aspect of the invention is applied to nozzles in the center jet position.

Figure 22:
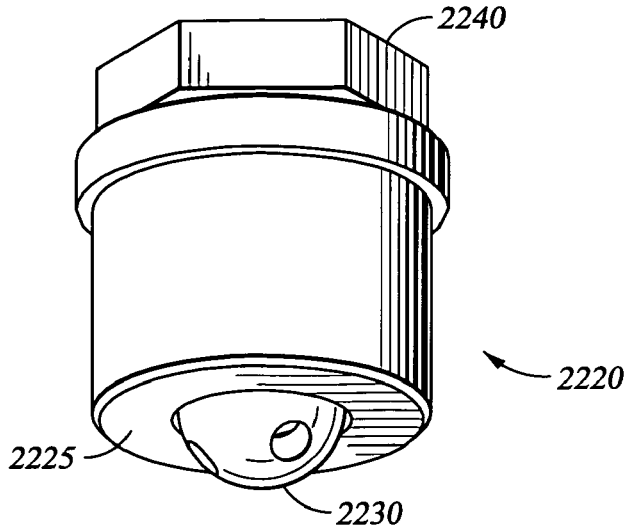
FIG. 22 is a perspective view of a nozzle orientation system.
Figure 23:
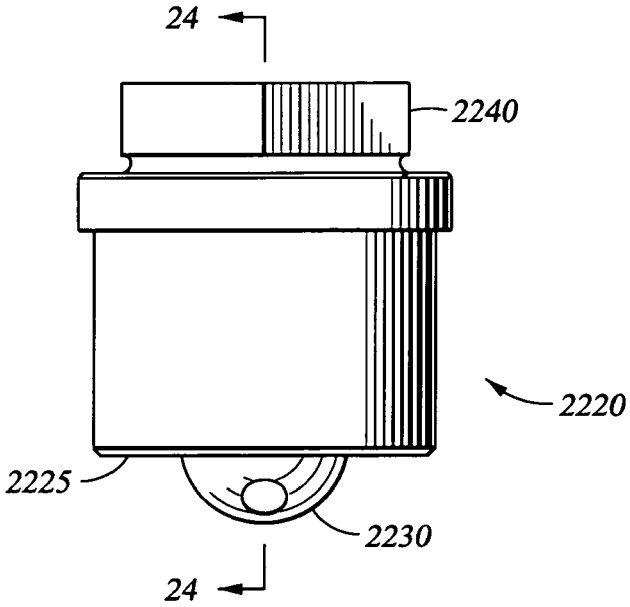
FIG. 23 is a side view of the nozzle orientation system of FIG. 22.
Figure 24:
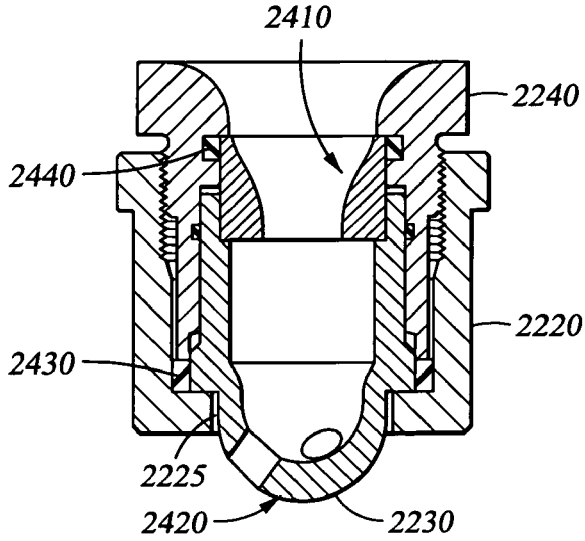
FIG. 24 is a cut-away view of a nozzle orientation system taken along line I—I of FIG. 23.

FIGS. 22 and 23 are external views of a weld-in nozzle sleeve. FIG. 24 is a cut-away view of the structure of FIG. 23, taken along cut line I—I of FIG. 23.

Sleeve 2220 includes a lip 2225 at its lower end. Protruding through a central hole in lip 2225 is an end 2230 of a multi-stage nozzle assembly. The top of a multiport retainer 2240 can also be seen. As would be appreciated by one of ordinary skill in the art, the lower end of sleeve 2220 may be welded into a nozzle receptacle orifice in the drill bit body similar to the manner by which nozzle sleeves are welded into the drill bit body.

Referring to FIG. 24, multi-stage assembly having upper restrictor nozzle 2410 and lower distribution nozzle 2420 fits inside sleeve 2220. Multi-stage retainer 2240 fits concentrically between the multi-stage assembly 2410, 2420 and the sleeve 2220 and provides a snug fit between the two. O-ring 2430 fits at the junction of all three and provides a first seal. O-ring 2440 fits between the exterior of the restrictor nozzle and the interior of the multi-stage retainer and provides a second seal.

Figure 25:
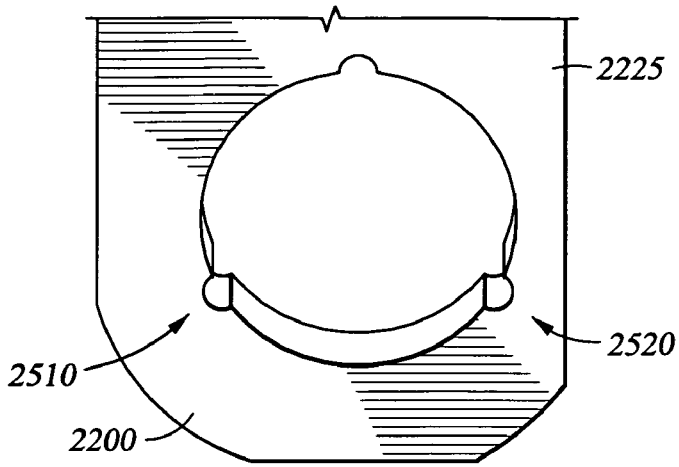
FIG. 25 is a bottom view of a sleeve having machined slots.
Figure 26:
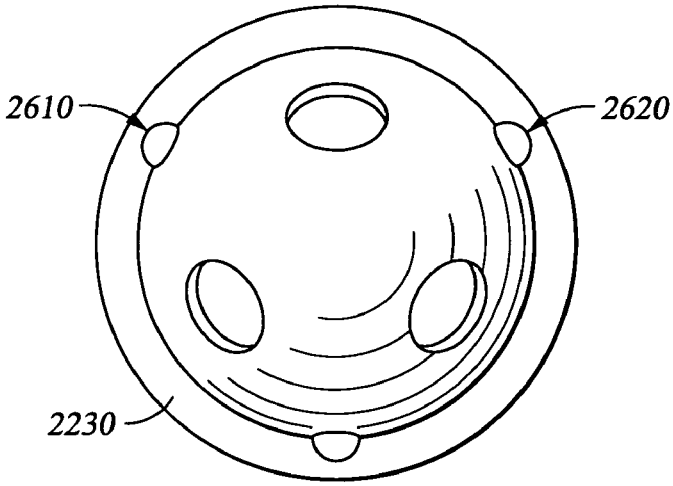
FIG. 26 is a bottom view of a distributor portion having lobes.
Figure 27:
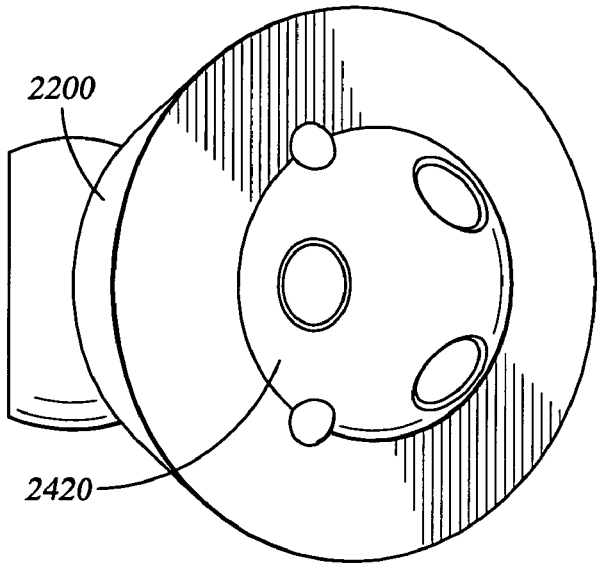
FIG. 27 is a bottom view of a distributor portion having lobes inserted in a sleeve having machined slots.

FIGS. 25–27 illustrate a preferred manner in which the multi-stage diffuser nozzle is fixedly oriented within the sleeve 2200.

FIG. 25 illustrates a bottom view of a weld-in nozzle sleeve 2200. Lip 2225 can also be seen, with cut-in slots 2510 and 2520. Additional slots may also be optionally provided. In addition, while a lip for placement of the slots is shown at the bottom of the sleeve, a surface for placement of the slots may be located at any suitable location along the interior of the sleeve 2200. Engage slots 2510 and 2520 are generally cylindrical, each slot shape being defined by a cylinder intersecting with the cylindrical hole in the bottom of the sleeve 2220. Other shapes (or more precisely, intersected shapes) for the engage slots are also suitable such squares, triangles, ellipticals, parabolic, etc. cuts may also be used.

FIG. 26 illustrates a bottom view of the end 2230 of the diffuser portion 2420 for a multi-stage nozzle. Lobes 2610 and 2620 can also be seen. Lobes 2610 and 2620 are sized to fixedly engage slots 2510 and 2520 to fix the multi-stage nozzle assembly in a fixed position. Just as with the slots, the lobes may have a variety of shapes, so long as the selected shapes of the slots and lobes prevent rotation of the nozzle 2410 relative to the sleeve 2220. Preferably, diffuser portion 2420 and sleeve 2220 are removably engageable, so that the lobes and slots slide axially with respect to one another when engaging. It is not desirable for the slot and lobe to have an interference fit since this would prevent and easy installation and remove of the nozzle from the orientation sleeve.

While the lobes as shown are located on the distributor portion of a multi-stage nozzle assembly, they may be located at any suitable location along a directional nozzle that engages a nozzle sleeve. However, a particular advantage of this aspect of the invention is when the lobes are placed on the exit side of the nozzle. This allows the system to operate regardless of the retention system on the top side of the nozzle. Thus, any suitable retention system can be used to retain the nozzle to the sleeve, such as a snap ring or threaded retainer.

FIG. 27 shows the diffuser portion 2420 of the nozzle assembly installed in the weld-in nozzle sleeve 2200. Thus, a nozzle with lobes 2610, 2620 fits in a mating set of cuts 2510, 2520 in a weld-in sleeve 2220 (shown in FIGS. 25 and 26). This fixes the orientation of the nozzle relative to the orientation of the weld-in sleeve.

It is notable that while the sleeve may have the same number of machined slots as the nozzle has lobes, this is not necessary to the invention. For example, the directional nozzle may include a single lobe, with the sleeve having three engagement locations such as cuts or slots. This would provide flexibility to an operator to adapt the drill bit for expected drilling conditions. For example, an operator may insert the directional nozzle having one lobe in any one of three positions for a sleeve that has three receptive slots. Similarly, the nozzle could have two lobes, with the sleeve having four slots. This would provide two alternate locations for installation of the nozzle in the sleeve.

It also should be noted that although the invention includes lobes that are manufactured as part of the distributor component, the lobes may be made formed from sheet metal or other suitable material and added to a machined distributor component by glue or other suitable means.

Drilling fluid flows from the fluid plenum of the drill bit (not shown) through a passage at the top of the multi-port retainer 2240. It then flows through the nozzle restrictor 2410 and distribution nozzle 2420 as previously described, where it is ejected into the bottom of the wellbore. The weld-in sleeve 2220 is fixed such that the fluid exiting the bit will impinge the fluid in pre-defined locations relative to the cutting structure. As can be appreciated, any nozzle that is designed to direct drilling fluid to a particular location on or relative to a component of a drill bit body needs to be fixedly oriented and thus will be assisted by this aspect of the invention.

One particularly effective application of a multi-stage diff-user nozzle is to reduce bit balling. As is known in the art, bit balling describes the packing of formation between the cones and bit body, or between the bit cutting elements, while cutting formation. When it occurs, the cutting elements are packed off so much that they don't penetrate into the formation effectively, tending to slow the rate of penetration for the drill bit (ROP). Cone cleaning reduces the problem of bit balling, and thus effective cone cleaning is a desirable feature of bit design.

It is believed particularly effective to combine a multi-stage diffuser center jet and a set of three diverging outer jet nozzles on a three-cone rock bit. A multi-stage nozzle carrying the typical amount of fluid flow (20–25%) is located at a center jet location. Because a conventional roller cone bit has three equally spaced cutting cones, the multi-stage nozzle would generally have a distributor portion with three equally spaced exit ports although it could have more or less than three if desired to improve the effectiveness of the nozzle. A centerline extends from each exit port and projects to within 0.4" from the closest tip of a cutting element at its nearest proximity on the respective cone (although a designer may wish to vary this distance depending on bit size and other conditions). Along the perimeter of the drill bit, at the three conventional locations for a three-cone rock bit, is placed three diverging nozzles.

Such a configuration was tested in the Dabbiya field in Abu Dhabi. It normally requires two milled tooth bits to drill the entire section because of bit balling. However, a drill bit with a multi-stage diff-user center jet and a set of three diverging outer jet nozzles drilled the entire interval with one bit in one run. This reduces costs, not only the cost of a drill bit but also the time it takes to remove a drill bit from the wellbore.

Figure 28:
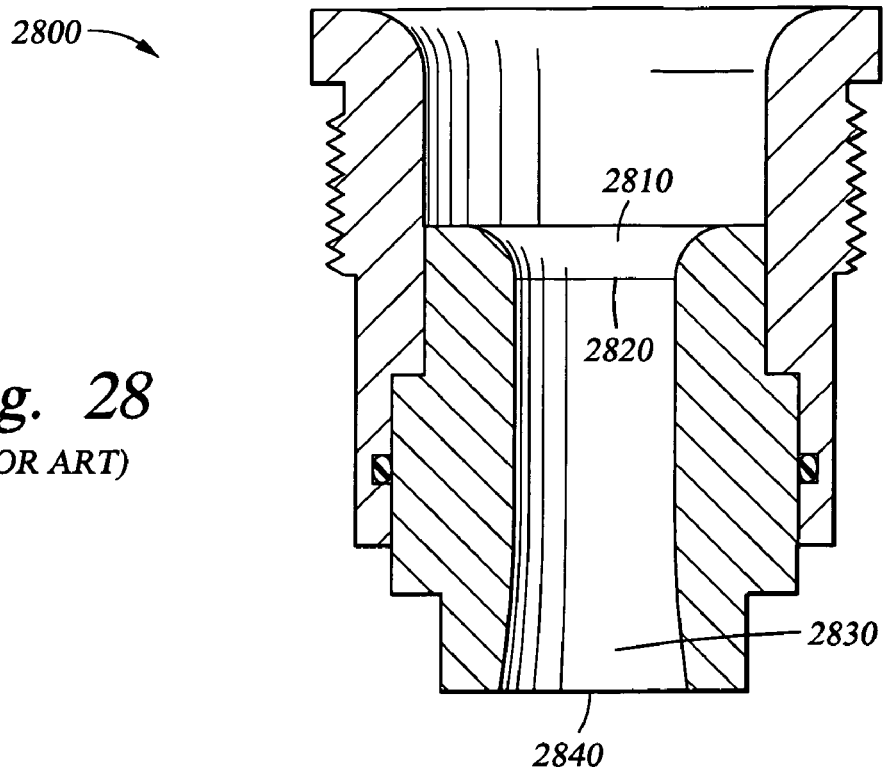
Fig. 28 (PRIOR ART)
FIG. 28 is a diverging nozzle.
Figure 29:
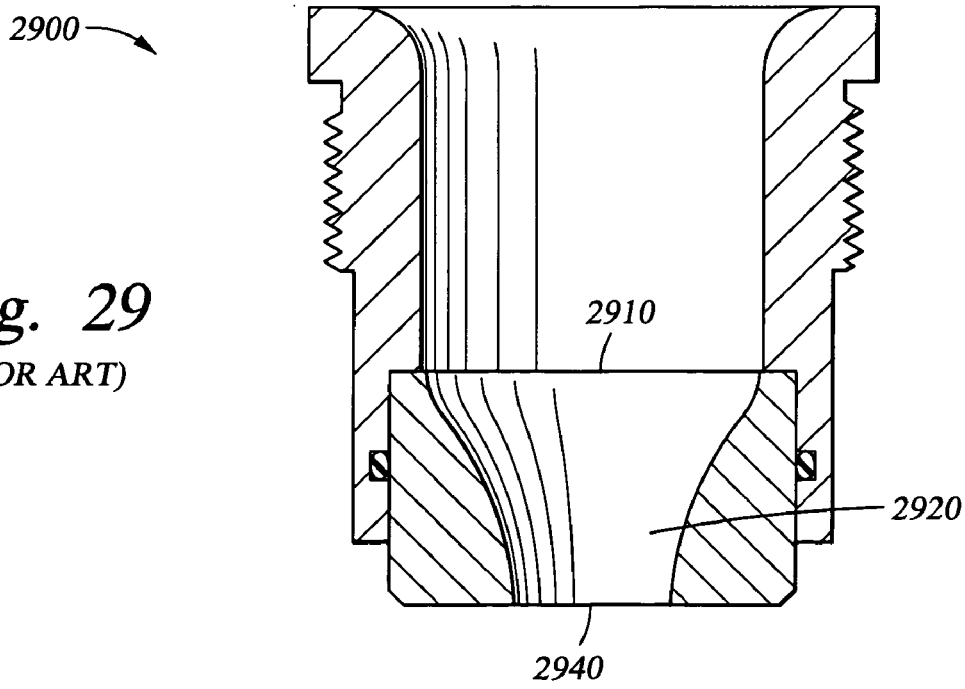
Fig. 29 (PRIOR ART)
FIG. 29 is a standard nozzle.

The design of a diverging nozzle is shown in FIG. 28. Diverging nozzle 2800 includes and entrance end 2810, a throat 2820 which is located at an area of minimum cross section within the nozzle, a diverging area 2830 where the fluid decelerates from its throat velocity and an exit end 2840. Diverging nozzles are well known to those skilled in the art for reducing the velocity of the fluid prior to exiting the confines of the nozzle. The lower velocity fluid is less prone to erode the cone. This type of nozzle is typically used in the center jet location to minimize erosion of the cone tips. A standard nozzle is shown in FIG. 29. Standard nozzle 2900 includes and entrance end 2910, a converging center 2920 and an exit end 2940. In the case of the standard nozzle shown, the throat of the nozzle is located at the surface of the exit end 2940 since the nozzle continuously converges up to that location.

Diverging nozzles distinguish from the standard nozzle shown in FIG. 29 because they have a lower exit velocity and their fluid jet is not as focused, leaving a larger, more diffused "footprint". If the fluid jet is thought of as a cone, the diffuser nozzle would project a larger cone angle. The use of diverging nozzles as the peripheral jets may be advantageous for a number of reasons. First, standard nozzles are positioned toward the borehole bottom and may not significantly clean the cutting elements of the roller cones. Because of the large cone angle of the diffuser nozzle, the fluid of the diffuser nozzle comes closer to the cutting elements that need cleaning. Diffuser nozzles can also be used in jet bores that are drilled such that the fluid is directed towards the cutting structure to remove formation that is "stuck" to them. Depending on the formation, the high velocity fluid from a standard nozzle can cause cone shell erosion. This is especially a problem when drilling sands or other formations with hard and/or sharp detritus particles. Since the diverging nozzles lower the exit velocity of the fluid, they help to minimize the erosion on the cones which is particularly helpful when the high velocity fluid passes so close (fluid core centerline distance within 0.4") to the cutters. The diffuser nozzle has the additional advantage that the velocity of the fluid ejected from the nozzle is lower than that ejected from a standard or angled nozzle. This allows more surface area on the cone may be affected by the fluid jet than by the angled nozzle without the accompanying erosion concerns. Given an adequate velocity for cleaning, this larger surface area results in better cleaning of the cutting elements and improved cone cleaning.

Testing has shown that there is an advantage of combining the use of a multi-stage diffuser nozzle in the center of the bit while using one or more diverging nozzles in the jet ports on the outer periphery of the bit. This combination is thought to be particularly advantageous since the diverging nozzles can more effectively clean the cone and cutting elements because the wider "foot print" of the exiting fluid will cover more area on the cone with high velocity fluid. Thus, the multi-stage diffuser nozzle is used to clean the inner rows of the cutting structure while the diverging nozzles on the outer periphery area are used to clean the further outboard cutters. Since both the multi-stage diffuser and the diverging nozzles are lowering the exit velocity of the fluid, they help to prevent cone shell that leads to bit failure. Yet, the combination of the two types of nozzles on the drill bit provides sufficient energy to the cone to maintain a clean cutting structure which helps to increase the penetration rate of the drill bit.

While preferred embodiments of this invention have been shown and described, other modifications can be made to these embodiments by one skilled in the art without departing from the spirit or teaching of this invention. For example, not all of the exit ports are required to be at non-central locations. The multi-stage diffuser nozzle may be employed on tools other than a drill bit, such as a hole reamer or hole opener. The embodiments described herein are exemplary only and are not limiting. Many variations and modifications of the system and apparatus are possible and are within the scope of the invention. Different aspects of the invention may be separately patentable. Accordingly, the scope of protection is not limited to the embodiments described herein, but is only limited by the claims which follow, the scope of which shall include all equivalents of the subject matter of the claims.

What is claimed is:

1. A drill bit, comprising:

a drill bit body forming an interior plenum, a pin end suitable for connection to a drill pipe with an internal passageway therethrough, and a cutting end suitable to cut a borehole;

a multi-stage diffuser nozzle assembly attached to said drill bit body and in fluid communication with said interior plenum, said multi-stage diffuser nozzle assembly comprising, a flow restrictor component in fluid communication with said interior plenum, said flow restrictor component having at least one internal passage to carry fluid, said interior passage having a throat with an effective cross-sectional area $A_{0E}$; a fluidic distributor component distinct from said flow restrictor component, said fluidic distributor component having a fluid entrance side connected to a fluid exit side, said fluid entrance side being in fluid communication with said interior passage of said flow restrictor and said fluid exit side having at least a first fluid exit port, wherein said fluid exit side connects to at least one distributor throat residing inside said fluidic distributor component, said at least one distributor throat having a total effective cross-sectional area $A_{1E}$, $A_{1E}$ being greater than $A_{0E}$, and wherein said at least one distributor throat occupies a location of minimum cross-sectional area in said fluidic distributor component; and an axis through said fluidic distributor component wherein a first fluid exit port on said fluid exit side of said fluidic distributor component is disposed to direct said fluid generally along a line that is non-collinear with said axis.

2. The drill bit of claim 1 wherein said drill bit body defines a longitudinal axis and said axis through said fluidic distributor component is parallel to said longitudinal axis.

3. The drill bit of claim 1, wherein said multi-stage diffuser nozzle assembly is distinct from said interior plenum.

4. The drill bit of claim 1, wherein said multi-stage diffuser nozzle assembly is indexed relative to said bit so that the first fluid exit port on said fluid exit side directs fluid flow to a predefined location.

5. The drill bit of claim 1, wherein said multi-stage diffuser nozzle assembly defines a central axis and wherein said multi-stage diffuser nozzle assembly includes at least two exit ports in said fluidic distributor, a first of said exit ports being non-collinear with said central axis.

6. The drill bit of claim 5, wherein the second of said exit ports is collinear with said central axis.

7. The drill bit of claim 5, wherein none of said exit ports are collinear with said central axis.

8. The drill bit of claim 1, wherein said multi-stage diffuser nozzle assembly includes two distributor throats, whose combined effective cross-sectional area corresponds to said effective cross-sectional area $A_{1E}$.

9. The drill bit of claim 1, wherein said flow restrictor component includes two internal passages, whose combined effective cross-sectional area corresponds to said effective cross-sectional area $A_{0E}$.

10. The drill bit of claim 1, wherein said diffuser nozzle assembly further comprises a fluid transition region between said flow restrictor component and said fluidic distributor component, said fluid transition region having an effective cross-sectional area $A_{2E}$, wherein $A_{2E}$ is greater than either $A_{1E}$ or $A_{0E}$.

11. The drill bit of claim 1, wherein said flow restrictor component has a varying cross-sectional area along its length.

12. The drill bit of claim 1, wherein said fluidic distributor component includes at least a first exit port connected to a first fluid channel and a second exit port connected to a second fluid channel, said first fluid channel having a maximum cross-sectional area greater than said second fluid channel.

13. The drill bit of claim 1, wherein said multi-stage diffuser includes a transition region between said flow restrictor and said fluidic distributor, said transition region dampening fluid oscillations.

14. The drill bit of claim 1, wherein said fluid exit side of said fluidic distributor includes a first exit port directing said fluid at a first vector angle and a second exit port directing said fluid at a second vector angle, said first and second vector angles being different.

15. The drill bit of claim 1, wherein said drill bit body further comprises a longitudinal axis and an outer peripheral surface around said drill bit body and wherein said multi-stage diffuser nozzle assembly defines a central axis, said central axis of said multi-stage diffuser nozzle assembly being located closer at said fluid exit side to said outer peripheral surface than to said longitudinal axis.

16. The drill bit of claim 1, wherein said multi-stage diffuser nozzle assembly includes a first fluid exit port of different size than a second fluid exit port on said multi-stage diffuser nozzle assembly.

17. The drill bit of claim 1, wherein said drill bit includes more than one of said multi-stage diffuser nozzle assemblies.

18. The drill bit of claim 17, wherein said drill bit is a roller cone drill bit.

19. The drill bit of claim 17, wherein said drill bit is a fixed cutter drag bit.

20. The drill bit of claim 1, wherein said drill bit is a roller cone drill bit.

21. The drill bit of claim 1, wherein said drill bit is a fixed cutter drag bit.

22. The drill bit of claim 1, said flow restrictor component being made from a more wear resistant material than said drill bit body.

23. The drill bit of claim 1, said flow restrictor component being made from tungsten carbide that is harder than the material comprising said drill bit body.

24. The drill bit of claim 1, said flow restrictor component being made from ceramic material that is harder than the material comprising said drill bit body.

25. The drill bit of claim 1, said fluidic distributor component being of a more wear resistant material than said drill bit body.

26. The drill bit of claim 1, said fluidic distributor component being made from tungsten carbide that is harder than the material comprising said drill bit body.

27. The drill bit of claim 1, said fluidic distributor component being made from ceramic material that is harder than the material comprising said drill bit body.

28. The drill bit of claim 1, wherein said flow restrictor component defines a first longitudinal axis and said fluidic distributor component defines a second longitudinal axis and wherein said first longitudinal axis and said second longitudinal axis are collinear.

29. The drill bit of claim 1, wherein said multi-stage diffuser nozzle assembly defines a longitudinal axis and said exit side of said fluidic distributor component defines an outer peripheral surface, the central axis for the first fluid exit port on said fluidic distributor being located not along the longitudinal axis of said multi-stage diffuser nozzle assembly, but closer to said longitudinal axis than to said outer peripheral surface.

30. The drill bit of claim 1, further comprising:

a leg with an interior side and an exterior side, said exterior side being a backface for said leg;

a cylindrical journal attached to said interior side of said leg, said cylindrical journal defining a journal axis to form an intersection between said journal axis and said backface;

a rotatable cone attached to said cylindrical journal, said rotatable cone having cutting elements;

wherein said exit side of said multi-stage diffuser nozzle assembly is above said intersection of said journal axis and said backface, said pin end of said drill bit being defined as the top of the drill bit.

31. The drill bit of claim 30, further comprising:

a second multi-stage diffuser, said second multi-stage diffuser having a fluid exit side above said intersection.

32. The drill bit of claim 1, wherein fluid ejected from said first fluid exit port is unbounded by said multi-stage diffuser nozzle assembly.

33. The drill bit of claim 1, wherein more than 35 percent of drilling fluid through said drill bit exits said multi-stage diffuser.

34. The drill bit of claim 1, wherein more than 75 percent of drilling fluid through said drill bit exits said multi-stage diffuser.

35. The drill bit of claim 1, wherein said multi-stage diffuser is free from cutting elements at its lower end.

36. The drill bit of claim 1, further comprising an orientation system for said multi-stage diffuser nozzle assembly, said orientation system comprising:

means for fixing an orientation of said nozzle assembly relative to said drill bit body.

37. The drill bit of claim 1, said multi-stage nozzle assembly further comprising:

a first end;

a second end, a length defined by said first end and said second end;

one or more lobes along at least a portion of said length of said multi-stage nozzle assembly; and a sleeve attached to said drill bit body, said sleeve having an inner surface and an outer surface, wherein said sleeve is suitable for receiving said multi-stage diffuser nozzle assembly along said inner surface, said slots being suitable to receive said lobes of said multi-stage nozzle assembly.

38. The drill bit of claim 1, further comprising:

a rotatable cutter cone attached to said cutting end of said drill bit, said cutter cone including a first cutting element with a cutting tip, wherein said first fluid port ejects fluid generally along a projected vector axis, said vector axis being within 0.4 inches from said cutting tip at their closest proximity.

39. The drill bit of claim 1, further comprising:

a rotatable cutter cone attached to said cutting end of said drill bit, said cutter cone including a first cutting element with a cutting tip, wherein said first fluid port ejects fluid generally along a vector axis, said vector axis impinging on said cutting tip at their closest proximity.

40. The drill bit of claim 1, further comprising:

a sleeve attached to said drill bit body, said sleeve being suitable to receive said multi-stage nozzle assembly, said multi-stage nozzle assembly being in fluid communication with said interior plenum.

41. The drill bit of claim 1, further comprising:

a sleeve attached between said multi-stage diffuser nozzle assembly and said drill bit body, said sleeve being suitable to receive said multi-stage nozzle assembly.

42. The drill bit of claim 1, further comprising:

a receptacle machined into said drill bit body, said receptacle being in fluid communication with said interior plenum and said receptacle suitable for receiving said multi-stage nozzle assembly.

43. The drill bit of claim 1, wherein said multi-stage diffuser nozzle assembly includes three distributor throats, whose combined cross-sectional area corresponds to said effective cross-sectional area $A_{1E}$.

44. The drill bit of claim 1, wherein said flow restrictor includes three internal passages, whose combined cross-sectional area corresponds to said effective cross-sectional area $A_{0E}$.

45. The drill bit of claim 1, wherein said multi-stage diffuser nozzle assembly includes at least four distributor throats, whose combined cross-sectional area corresponds to said effective cross-sectional area $A_{1E}$.

46. The drill bit of claim 1, wherein said flow restrictor includes at least four internal passages, whose combined cross-sectional area corresponds to said effective cross-sectional area $A_{0E}$.

47. The drill bit of claim 1, wherein more than 90 percent of drilling fluid through said drill bit exits said multi-stage diffuser.

48. The drill bit of claim 1, wherein said flow restrictor component defines a centroidal restrictor axis and said fluidic distributor component defines a centroidal fluidic distributor axis, said centroidal restrictor axis being in alignment with said centroidal fluidic distributor axis.

49. The drill bit of claim 1 wherein said multi-stage diffuser nozzle assembly defines a longitudinal axis, wherein said fluid exit side of said fluidic distributor at a first exit port is disposed to direct at least a portion of said fluid along a path that is non-collinear with said nozzle axis.

50. The drill bit of claim 1, wherein said multi-stage diffuser nozzle defines a central axis and wherein said multi-stage diffuser nozzle includes the exit port in said fluidic distributor, said exit port defining an exit port axis that is non-collinear and non-parallel to said central axis.

51. The drill bit of claim 1, wherein said drill bit body defines a longitudinal axis and said flow restrictor component defines a central axis, said first fluid exit port defining an exit port axis that is non-collinear and non-parallel to said central axis and said longitudinal axis.

52. The drill bit of claim 1 wherein said fluidic distributor component includes a relatively straight channel defining a distributor axis and wherein said first exit port defines an exit axis, said distributor axis and said exit axis being non-parallel.

53. The drill bit of claim 1, further comprising:

a rotatable cutter cone attached to said cutting end of said drill bit, said cutter cone including a first cutting element with a cutting tip, wherein said first fluid port ejects fluid generally along a projected vector axis, said vector axis being within 0.25 inches from said cutting tip at their closest proximity.

54. The drill bit of claim 1, further comprising:

a rotatable cutter cone attached to said cutting end of said drill bit, said cutter cone including a first cutting element with a cutting tip, wherein said first fluid port ejects fluid generally along a projected vector axis, said vector axis being within 0.5 inches from said cutting tip at their closest proximity.

55. The drill bit of claim 1, wherein said drill bit comprises a plurality of roller cones and said fluid exit side of said fluidic distributor at said first exit port is disposed to direct said fluid onto one of said roller cones.

56. A drill bit, comprising:

a drill bit body forming an interior plenum, a pin end suitable for connection to a drill pipe with an internal passageway therethrough, and a cutting end suitable to cut a borehole;

a multi-stage diffuser nozzle assembly attached to said drill bit body and in fluid communication with said interior plenum, said multi-stage diffuser nozzle assembly comprising, a flow restrictor component in fluid communication with said interior plenum, said flow restrictor component having at least one internal passage to carry fluid, said interior passage having a throat with a physical cross-sectional area $A_{0P}$;

a fluidic distributor component distinct from said flow restrictor component, said fluidic distributor having a fluid entrance side connected to a fluid exit side, said fluid entrance side being in fluid communication with said interior passage of said flow restrictor and said fluid exit side having at least a first fluid exit port, wherein said fluid exit side connects to at least one distributor throat residing inside said fluidic distributor component, said at least one distributor throat having a total physical cross-sectional area $A_{1P}$, $A_{1P}$ being greater than $A_{0P}$, and wherein said at least one distributor throat occupies a location of minimum cross-sectional area in said fluidic distributor component; and an axis through said fluidic distributor component wherein a first fluid exit port on said fluid exit side of said fluidic distributor component is disposed to direct said fluid generally along a line that is non-collinear with said axis.

57. The drill bit of claim 56, wherein said drill bit body defines a longitudinal axis and said axis through said fluidic distributor component is parallel to said longitudinal axis.

58. The drill bit of claim 56, wherein said multi-stage diffuser nozzle assembly defines a longitudinal axis, wherein said fluid exit side of said fluidic distributor at a first exit port is disposed to direct at least a portion of said fluid along a path that is non-collinear with said nozzle axis.

59. The drill bit of claim 56, wherein said multi-stage diffuser nozzle assembly is distinct from said interior plenum.

60. The drill bit of claim 56, wherein said multi-stage diffuser nozzle assembly is indexed relative to said bit so that distributor exit ports on said fluid exit side direct fluid flow to predefined locations.

61. The drill bit of claim 56, wherein said multi-stage diffuser nozzle assembly defines a central axis and wherein said multi-stage diffuser nozzle assembly includes at least two exit ports in said fluidic distributor, a first of said exit ports being non-collinear with said central axis.

62. The drill bit of claim 61, wherein the second of said exit ports is collinear with said central axis.

63. The drill bit of claim 61, wherein none of said exit ports are collinear with said central axis.

64. The drill bit of claim 56, wherein said fluidic distributor includes two_distributor throats, whose combined physical cross-sectional area corresponds to said physical cross-sectional area $A_{1P}$.

65. The drill bit of claim 56, wherein said flow restrictor component includes two internal passages, whose combined physical cross-sectional area corresponds to said physical cross-sectional area $A_{0P}$.

66. The drill bit of claim 56, wherein said diffuser nozzle assembly further comprises a fluid transition region between said flow restrictor component and said fluidic distributor component, said fluid transition region having an physical cross-sectional area $A_{2P}$, wherein $A_{2P}$ is greater than either $A_{1P}$ or $A_{0P}$.

67. The drill bit of claim 56, wherein said flow restrictor component has a varying cross-sectional area along its length.

68. The drill bit of claim 56, wherein said fluidic distributor component includes the first exit port connected to a first fluid channel and a second exit port connected to a second fluid channel, said first fluid channel having a maximum cross-sectional area greater than said second fluid channel.

69. The drill bit of claim 56, wherein said multi-stage diffuser includes a transition region between said flow restrictor and said fluidic distributor, said transition region dampening fluid oscillations.

70. The drill bit of claim 56, wherein said fluid exit side of said fluidic distributor includes the first exit port directing said fluid at a first vector angle and a second exit port directing said fluid at a second vector angle, said first and second vector angles being different.

71. The drill bit of claim 56, wherein said drill bit body further comprises a longitudinal axis and an outer peripheral surface around said drill bit body and wherein said multi-stage diffuser nozzle assembly defines a central axis, said central axis of said multi-stage diffuser nozzle assembly being located closer at said fluid exit side to said outer peripheral surface than to said longitudinal axis.

72. The drill bit of claim 56, wherein said multi-stage diffuser nozzle assembly includes a first fluid exit port of different size than a second fluid exit port on said multi-stage diffuser nozzle assembly.

73. The drill bit of claim 56, wherein said drill bit includes more than one of said multi-stage diffuser nozzle assemblies.

74. The drill bit of claim 56, wherein said drill bit is a roller cone drill bit.

75. The drill bit of claim 56, wherein said drill bit is a fixed cutter drag bit.

76. The drill bit of claim 56, said flow restrictor component being made from a more wear resistant material than said drill bit body.

77. The drill bit of claim 56, said flow restrictor component being made from tungsten carbide that is harder than the material comprising said drill bit body.

78. The drill bit of claim 56, said flow restrictor component being made from ceramic material that is harder than the material comprising said drill bit body.

79. The drill bit of claim 56, said fluidic distributor component being of a more wear resistant material than said drill bit body.

80. The drill bit of claim 56, said fluidic distributor component being made from tungsten carbide that is harder than the material comprising said drill bit body.

81. The drill bit of claim 56, said fluidic distributor component being made from ceramic material that is harder than the material comprising said drill bit body.

82. The drill bit of claim 56, wherein said flow restrictor component defines a first longitudinal axis and said fluidic distributor component defines a second longitudinal axis and wherein said first longitudinal axis and said second longitudinal axis are collinear.

83. The drill bit of claim 56, wherein said multi-stage diffuser nozzle assembly defines a longitudinal axis and said exit side of said fluidic distributor component defines an outer peripheral surface, the central axis for the first fluid exit port on said fluidic distributor being located not along the longitudinal axis of said multi-stage diffuser nozzle assembly, but closer to said longitudinal axis than to said outer peripheral surface.

84. The drill bit of claim 56, further comprising:

a leg with an interior side and an exterior side, said exterior side being a backface for said leg;

a cylindrical journal attached to said interior side of said leg, said cylindrical journal defining a journal axis to form an intersection between said journal axis and said backface;

a rotatable cone attached to said cylindrical journal, said rotatable cone having cutting elements;

wherein said exit side of said multi-stage diffuser nozzle assembly is above said intersection of said journal axis and said backface, said pin end of said drill bit being defined as the top of the drill bit.

85. The drill bit of claim 84, further comprising:

a second multi-stage diffuser, said second multi-stage diffuser having a fluid exit side above said intersection.

86. The drill bit of claim 56, wherein fluid ejected from said first fluid exit port is unbounded by said multi-stage diffuser nozzle assembly.

87. The drill bit of claim 56, wherein more than 35 percent of drilling fluid through said drill bit exits said multi-stage diffuser.

88. The drill bit of claim 56, wherein more than 75 percent of drilling fluid through said drill bit exits said multi-stage diffuser.

89. The drill bit of claim 56, wherein said multi-stage diffuser is free from cutting elements at its lower end.

90. The drill bit of claim 56, further comprising an orientation system for said multi-stage diffuser nozzle assembly, said orientation system comprising:

means for fixing an orientation of said nozzle assembly relative to said drill bit body.

91. The drill bit of claim 56, said multi-stage nozzle assembly further comprising:

a first end;

a second end, a length defined by said first end and said second end;

one or more lobes along at least a portion of said length of said multi-stage nozzle assembly; and a sleeve attached to said drill bit body, said sleeve having an inner surface and an outer surface, wherein said sleeve is suitable for receiving said multi-stage diffuser assembly along said inner surface, said slots being suitable to receive said lobes of said multi-stage nozzle assembly.

92. The drill bit of claim 56, further comprising:

a rotatable cutter cone attached to said cutting end of said drill bit, said cutter cone including a first cutting element with a cutting tip, wherein said first fluid port ejects fluid generally along a projected vector axis, said vector axis being within 0.4 inches from said cutting tip at their closest proximity.

93. The drill bit of claim 56, further comprising:

a rotatable cutter cone attached to said cutting end of said drill bit, said cutter cone including a first cutting element with a cutting tip, wherein said first fluid port ejects fluid generally along a vector axis, said vector axis impinging on said cutting tip at their closest proximity.

94. The drill bit of claim 56, further comprising:

a sleeve attached to said drill bit body, said sleeve being suitable to receive said multi-stage nozzle assembly, said multi-stage nozzle assembly being in fluid communication with said interior plenum.

95. The drill bit of claim 56, further comprising:

a sleeve attached between said diffuser nozzle assembly and said drill bit body, said sleeve being also being suitable to receive said multi-stage nozzle assembly.

96. The drill bit of claim 56, further comprising:

a receptacle machined into said drill bit body, said receptacle being in fluid communication with said interior plenum and said receptacle suitable for receiving said multi-stage nozzle assembly.

97. The drill bit of claim 56, wherein said multi-stage diffuser nozzle assembly includes three distributor throats, whose combined cross-sectional area corresponds to said physical cross-sectional area $A_{1P}$.

98. The drill bit of claim 56, wherein said flow restrictor includes three internal passages, whose combined cross-sectional area corresponds to said physical cross-sectional area $A_{0P}$.

99. The drill bit of claim 56, wherein said multi-stage diffuser nozzle assembly includes at least four distributor throats, whose combined cross-sectional area corresponds to said physical cross-sectional area $A_{1P}$.

100. The drill bit of claim 56, wherein said flow restrictor includes at least four internal passages, whose combined cross-sectional area corresponds to said physical cross-sectional area $A_{0P}$.

101. The drill bit of claim 56, wherein more than 90 percent of drilling fluid through said drill bit exits said multi-stage diffuser.

102. The drill bit of claim 56, wherein said flow restrictor component defines a centroidal restrictor axis and said fluidic distributor component defines a centroidal fluidic distributor axis, said centroidal restrictor axis being in alignment with said centroidal fluidic distributor axis.

103. The drill bit of claim 56, wherein said multi-stage diffuser nozzle defines a central axis and wherein said multi-stage diffuser nozzle includes the exit port in said fluidic distributor, said exit port defining an exit port axis that is non-collinear and non-parallel to said central axis.

104. The drill bit of claim 56, further comprising:

a rotatable cutter cone attached to said cutting end of said drill bit, said cutter cone including a first cutting element with a cutting tip, wherein said first fluid port ejects fluid generally along a projected vector axis, said vector axis being within 0.25 inches from said cutting tip at their closest proximity.

105. The drill bit of claim 56, further comprising:

a rotatable cutter cone attached to said cutting end of said drill bit, said cutter cone including a first cutting element with a cutting tip, wherein said first fluid port ejects fluid generally along a projected vector axis, said vector axis being within 0.5 inches from said cutting tip at their closest proximity.

106. The drill bit of claim 56, wherein said drill bit comprises a plurality of roller cones and said fluid exit side of said fluidic distributor at said first exit port is disposed to direct said fluid onto one of said roller cones.

107. A drill bit, comprising:

a drill bit body defining a bit body longitudinal axis and including an outer periphery;

a multi-stage diffuser nozzle attached to said drill bit body, for directing drilling fluid from said drill bit body to a selected location, said nozzle comprising an upper restrictor portion having an effective internal cross-sectional area of $A_{0E}$;

a lower distributor portion having an effective internal cross-sectional area of $A_{1E}$, where effective area $A_{1E}$ is greater than effective area $A_{0E}$;

wherein said multi-diffuser nozzle defines a nozzle longitudinal axis and said lower distributor portion directs said drilling fluid generally along a trajectory other than along said nozzle longitudinal axis.

108. The drill bit of claim 107, wherein said restrictor portion and said distributor portion are manufactured from a single component.

109. The drill bit of claim 107, wherein said multi-stage diffuser nozzle further comprises a transition region between said upper restrictor portion and said lower distributor portion, said transition region dampening pressure fluctuations in said drilling fluid.

110. The drill bit of claim 107, wherein said upper restrictor portion comprises a single channel having a throat and said lower distributor portion comprises multiple channels, and wherein said effective cross-sectional area of said throat is less than the effective cross-sectional area of the combined multiple channels at their most narrow cross-sections.

111. The drill bit of claim 110, wherein said single channel of said upper restrictor portion has a varying cross-sectional area along its length.

112. The drill bit of claim 107, wherein said restrictor portion and said distributor portion are manufactured from separable elements.

113. The drill bit of claim 107, wherein said drill bit body defines a longitudinal axis, there being a nozzle axis through said multi-stage diffuser nozzle assembly that is parallel to said longitudinal axis, wherein a fluid exit side of a fluidic distributor at a first exit port is disposed to direct said fluid generally along a line that is non-collinear with said nozzle axis.

114. The drill bit of claim 107, wherein said multi-stage diffuser nozzle assembly defines a central axis and wherein said multi-stage diffuser nozzle assembly includes at least two exit ports in a fluidic distributor, a first of said exit ports being non-collinear with said central axis.

115. The drill bit of claim 114, wherein the second of said exit ports is collinear with said central axis.

116. The drill bit of claim 107, wherein said fluid exit side of said fluidic distributor includes a first exit port directing said fluid at a first vector angle and a second exit port directing said fluid at a second vector angle, said first and second vector angles being different.

117. The drill bit of claim 107, further comprising:

a rotatable cutter cone attached to said cutting end of said drill bit, said cutter cone including a first cutting element with a cutting tip, wherein said first fluid port ejects fluid generally along a projected vector axis, said vector axis being within 0.4 inches from said cutting tip at their closest proximity.

118. The drill bit of claim 107, further comprising:

a rotatable cutter cone attached to said cutting end of said drill bit, said cutter cone including a first cutting element with a cutting tip, wherein a first fluid port ejects fluid generally along a vector axis, said vector axis impinging on said cutting tip at their closest proximity.

119. The drill bit of claim 107, further comprising:

a rotatable cutter cone attached to said cutting end of said drill bit, said cutter cone including a first cutting element with a cutting tip, wherein a first fluid port ejects fluid generally along a projected vector axis, said vector axis being within 0.25 inches from said cutting tip at their closest proximity.

120. The drill bit of claim 107, further comprising:

a rotatable cutter cone attached to said cutting end of said drill bit, said cutter cone including a first cutting element with a cutting tip, wherein a first fluid port ejects fluid generally along a projected vector axis, said vector axis being within 0.5 inches from said cutting tip at their closest proximity.

121. The drill bit of claim 107, wherein said drill bit comprises a plurality of roller cones and said lower distributor portion directs said drilling fluid onto one of said roller cones.

122. A method of controlling fluid flow through a drill bit, comprising:

lowering the fluid pressure of drilling fluid flowing through said drill bit from an initial pressure to a restrictor pressure;

raising the restrictor pressure to a transition pressure while dampening fluid pressure oscillations in said drilling fluid;

lowering the transition pressure to a diffuser channel pressure;

altering said diffuser channel pressure to an exit pressure, said diffuser channel pressure being higher than said restrictor pressure;

raising said fluid pressure from said restrictor pressure to a transition pressure, said transition pressure being less than said initial pressure;

wherein said dampening step stabilizes said fluid pressure at said transition pressure; and wherein said fluid pressure is altered to said exit pressure by a plurality of exit channels in a nozzle body.

123. The drill bit of claim 122, wherein said exit channels direct said drilling fluid onto a plurality of roller cones proximal to said exit channels.

124. A multi-stage diffuser nozzle, comprising:

means for lowering fluid pressure from an initial pressure to a restrictor pressure;

means for raising said restrictor pressure to a transition pressure;

means for lowing the transition pressure to a diffuser channel pressure;

means for altering said diffuser channel pressure to an exit pressure higher than said restrictor pressure and lower than said initial pressure, said means for altering said fluid pressure directing fluid at a non-zero angle to a longitudinal axis running through said multi-stage diffuser nozzle.

125. The multi-stage diffuser nozzle of claim 124, farther comprising:

means for dampening fluid pressure fluctuations in said drilling fluid, said means for dampening raising said fluid pressure from said restrictor pressure to a transition pressure.

126. The drill bit of claim 124, wherein said means for altering said fluid pressure directs said fluid onto a plurality of roller cones proximal to said means for altering said fluid pressure.

127. A multi-stage nozzle, compromising:

a flow restrictor having an internal passage to carry fluid, said interior passage having a throat with an effective cross-sectional area $A_{0E}$, said internal passage of said flow restrictor defining a central axis; and a fluidic distributor, said fluidic distributor having at least one fluid entrance port connected to at least one fluid exit port, said at least one fluid entrance port being in fluid communication with said interior passage of said flow restrictor, wherein said fluidic distributor presents an effective cross-sectional area $A_{1E}$ to said fluid, said effective cross-sectional area $A_{1E}$ being greater than said effective cross-sectional area $A_{0E}$;

wherein said at least one fluid exit port ejects said fluid generally along a vector axis, said vector axis being non-parallel to said central axis.

128. The nozzle of claim 127, wherein said flow restrictor and said fluidic distributor are manufactured from a single component.

129. The nozzle of claim 127, wherein said flow restrictor and said fluidic distributor are manufactured from distinct components.

130. The drill bit of claim 127, wherein said fluid exit side of said fluidic distributor includes a first exit port directing said fluid at a first vector angle and a second exit port directing said fluid at a second vector angle, said first and second vector angles being different.

131. A drill bit, comprising:

a drill bit body forming an interior plenum, a pin end suitable for connection to a drill pipe with an internal passageway therethrough, and a cutting end suitable to cut a borehole;

a multi-stage diffuser nozzle assembly attached to said drill bit body and in fluid communication with said interior plenum, said multi-stage diffuser nozzle assembly comprising, a flow restrictor component in fluid communication with said interior plenum, said flow restrictor component having at least one internal passage to carry fluid, said interior passage having a throat with drilling fluid passing there through and where said drilling fluid has an average velocity $V_0$ in said flow restrictor throat;

a fluidic distributor component distinct from said flow restrictor component, said fluidic distributor component having a fluid entrance side connected to a fluid exit side, said fluid entrance side being in fluid communication with said interior passage of said flow restrictor and said fluid exit side having at least a first fluid exit port, wherein said at least a first fluid exit port has a port entrance side and a port exit side, said port having drilling fluid passing there through said drilling fluid having an average velocity $V_1$ at said port exit side, where $V_0$ is greater than $V_1$, and wherein said at least one distributor exit port occupies a location in said fluidic distributor component; and an axis through said fluidic distributor component wherein a first fluid exit port on said fluid exit side of said fluidic distributor component is disposed to direct said fluid generally along a line that is non-collinear with said axis.

132. The drill bit of claim 131 wherein said drill bit body defines a longitudinal axis and said axis through said fluidic distributor component is parallel to said longitudinal axis.

133. The drill bit of claim 131, wherein said multi-stage diffuser nozzle assembly defines a central axis and wherein said multi-stage diffuser nozzle assembly includes at least two exit ports in said fluidic distributor, a first of said exit ports being non-collinear with said central axis.

134. The drill bit of claim 133, wherein the second of said exit ports is collinear with said central axis.

135. The drill bit of claim 133, wherein said fluid exit side of said fluidic distributor includes a first exit port directing said fluid at a first vector angle and a second exit port directing said fluid at a second vector angle, said first and second vector angles being different.

136. The drill bit of claim 131, further comprising:

a rotatable cutter cone attached to said cutting end of said drill bit, said cutter cone including a first cutting element with a cutting tip, wherein said first fluid port ejects fluid generally along a projected vector axis, said vector axis being within 0.4 inches from said cutting tip at their closest proximity.

137. The drill bit of claim 131, further comprising:

a rotatable cutter cone attached to said cutting end of said drill bit, said cutter cone including a first cutting element with a cutting tip, wherein said first fluid port ejects fluid generally along a vector axis, said vector axis impinging on said cutting tip at their closest proximity.

138. The drill bit of claim 131, further comprising:

a rotatable cutter cone attached to said cutting end of said drill bit, said cutter cone including a first cutting element with a cutting tip, wherein said first fluid port ejects fluid generally along a projected vector axis, said vector axis being within 0.25 inches from said cutting tip at their closest proximity.

139. The drill bit of claim 131, further comprising:

a rotatable cutter cone attached to said cutting end of said drill bit, said cutter cone including a first cutting element with a cutting tip, wherein said first fluid port ejects fluid generally along a projected vector axis, said vector axis being within 0.5 inches from said cutting tip at their closest proximity.

140. The drill bit of claim 131, wherein said drill bit comprises a plurality of roller cones and said fluid exit side of said fluidic distributor at said first exit port is disposed to direct said fluid onto one of said roller cones.

141. A drill bit, comprising:

a drill bit body having a pin end and a cutting end and defining a longitudinal axis along a central portion of said drill bit body;

cutting elements attached to said cutting end of said drill bit body;

a multi-stage diffuser nozzle attached to said drill bit body, said multi-stage diffuser nozzle being located in said central portion of said drill bit body, said multi-stage diffuser nozzle comprising, a flow restrictor in fluid communication with said interior plenum, said flow restrictor having at least one internal passage to carry fluid, said interior passage having a throat with a physical cross-sectional area $A_{0P}$; and a fluidic distributor, said fluidic distributor having a fluid entrance side connected to a fluid exit side, said fluid entrance side being in fluid communication with said interior passage of said flow restrictor and said fluid exit side having at least a first fluid exit port, wherein said fluid exit side connects to at least one distributor throat residing inside said fluidic distributor, said at least one distributor throat having a total physical cross-sectional area $A_{1P}$, $A_{1P}$ being greater than $A_{0P}$, and wherein said at least one distributor throat occupies a location of minimum cross-sectional area in said fluidic distributor, wherein said fluidic distributor directs fluid of maximum velocity along a vector, said vector being non-parallel to said longitudinal axis;

and a diverging nozzle attached to said drill bit body, said diverging nozzle being located in a non-central portion of said drill bit body, said diverging nozzle comprising, a diverging nozzle body defining a fluid passage having a first cross-sectional area at a most narrow location;

an entrance end; and an exit end having a fluid exit, said fluid exit having a second cross-sectional area, wherein said first cross-sectional area is less than said second cross-sectional area.

142. The drill bit of claim 141, further comprising:

a second diffuser nozzle attached to said drill bit body, said second diffuser nozzle being located in a non-central portion of said drill bit body.

143. The drill bit of claim 141, said flow restrictor and said fluidic distributor being distinct components.

144. The drill bit of claim 141, said flow restrictor and said fluidic distributor being manufactured from a single component.

145. The drill bit of claim 141, wherein said fluid exit side of said fluidic distributor includes a first exit port directing said fluid at a first vector angle and a second exit port directing said fluid at a second vector angle, said first and second vector angles being different.

146. The drill bit of claim 141, further comprising:

a rotatable cutter cone attached to said cutting end of said drill bit, said cutter cone including a first cutting element with a cutting tip, wherein said first fluid port ejects fluid generally along a projected vector axis, said vector axis being within 0.4 inches from said cutting tip at their closest proximity.

147. The drill bit of claim 141, further comprising:

a rotatable cutter cone attached to said cutting end of said drill bit, said cutter cone including a first cutting element with a cutting tip, wherein said first fluid port ejects fluid generally along a vector axis, said vector axis impinging on said cutting tip at their closest proximity.

148. The drill bit of claim 141, further comprising:

a rotatable cutter cone attached to said cutting end of said drill bit, said cutter cone including a first cutting element with a cutting tip, wherein said first fluid port ejects fluid generally along a projected vector axis, said vector axis being within 0.25 inches from said cutting tip at their closest proximity.

149. The drill bit of claim 141, further comprising:

a rotatable cutter cone attached to said cutting end of said drill bit, said cutter cone including a first cutting element with a cutting tip, wherein said first fluid port ejects fluid generally along a projected vector axis, said vector axis being within 0.5 inches from said cutting tip at their closest proximity.

150. A multi-stage nozzle, compromising:

a flow restrictor having an internal passage to carry fluid, said interior passage having a throat with an physical cross-sectional area $A_{0P}$, said internal passage of said flow restrictor defining a central axis; and a fluidic distributor, said fluidic distributor having at least one fluid entrance port connected to at least one fluid exit port, said at least one fluid entrance port being in fluid communication with said interior passage of said flow restrictor, wherein said fluidic distributor presents an physical cross-sectional area $A_{1P}$ to said fluid, said physical cross-sectional area $A_{1P}$ being greater than said physical cross-sectional area $A_{0P}$;

wherein said at least one fluid exit port ejects said fluid generally along a vector axis, said vector axis being non-parallel to said central axis.

151. The nozzle of claim 150, wherein said flow restrictor and said fluidic distributor are manufactured from a single component.

152. The nozzle of claim 150, wherein said flow restrictor and said fluidic distributor are manufactured from distinct components.

153. The drill bit of claim 150, wherein said fluid exit side of said fluidic distributor includes a first exit port directing said fluid at a first vector angle and a second exit port directing said fluid at a second vector angle, said first and second vector angles being different.

* * * * *